US011400563B2

(12) United States Patent
Inoue

(10) Patent No.: US 11,400,563 B2
(45) Date of Patent: Aug. 2, 2022

(54) PROCESSING METHOD FOR DISK-SHAPED WORKPIECE

(71) Applicant: DISCO CORPORATION, Tokyo (JP)

(72) Inventor: Yuki Inoue, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 363 days.

(21) Appl. No.: 16/704,271

(22) Filed: Dec. 5, 2019

(65) Prior Publication Data

US 2020/0180105 A1 Jun. 11, 2020

(30) Foreign Application Priority Data

Dec. 7, 2018 (JP) ..... JP2018-229799
Oct. 25, 2019 (JP) ..... JP2019-194320

(51) Int. Cl.
*B24B 51/00* (2006.01)
*B24B 37/30* (2012.01)

(52) U.S. Cl.
CPC ..... *B24B 51/00* (2013.01); *B24B 37/30* (2013.01)

(58) Field of Classification Search
CPC ..... B24B 37/26; B24B 37/22; B24B 37/20; B24B 37/205
USPC ..... 451/526–527, 529, 533–534
See application file for complete search history.

(56) References Cited

U.S. PATENT DOCUMENTS

2017/0095902 A1* 4/2017 Yoshida ..... B24B 49/04

FOREIGN PATENT DOCUMENTS

| | | | |
|---|---|---|---|
| JP | 2005153090 A | | 6/2005 |
| JP | 2008264913 A | * | 11/2008 |
| JP | 2013119123 A | * | 6/2013 |
| JP | 2013119123 A | | 6/2013 |
| JP | 2015223636 A | | 12/2015 |

OTHER PUBLICATIONS

English Translation of JP 2008264913 (Year: 2008).*
English Translation of JP 2013119123 (Year: 2013).*

* cited by examiner

*Primary Examiner* — Joel D Crandall
(74) *Attorney, Agent, or Firm* — Greer, Burns & Crain, Ltd.

(57) ABSTRACT

A processing method for a disk-shaped workpiece includes a holding step of causing a holding table to hold a disk-shaped workpiece, a step of rotating the workpiece and a grinding wheel to grind the workpiece, a step of rotating the workpiece after ground and the polishing pad to polish the workpiece, a step of measuring, after polishing, a thickness of the workpiece at least at two measurement points of a first measurement point of a center of the workpiece and a second measurement point in a proximity of at an outer circumferential edge of the workpiece, a step of recognizing a thickness tendency in a diametrical direction of the workpiece from the measured thicknesses of the workpiece, and a step of changing an inclination relationship between a rotation shaft for rotating the grinding wheel and a rotation shaft of the table on the basis of the recognized thickness tendency.

8 Claims, 16 Drawing Sheets

PROCESSING METHOD FOR DISK-SHAPED WORKPIECE

BACKGROUND OF THE INVENTION

Field of the Invention

The present invention relates to a processing method for grinding and polishing a disk-shaped workpiece.

Description of the Related Art

In the case where a device chip is fabricated from a disk-shaped workpiece or the like, as disclosed in Japanese Patent Laid-Open No. 2005-153090, a polishing target face is polished by a polishing pad having a polishing face of an area sufficient to cover the polishing target face of the disk-shaped workpiece after the disk-shaped workpiece is ground by whetstones so as to be thinned.

In the grinding process, a grinding wheel on which whetstones are disposed annularly is rotated such that the disk-shaped workpiece is ground to a uniform thickness by the whetstones. In order to grind a disk-shaped workpiece to a uniform thickness, as disclosed in Japanese Patent Laid-Open No. 2013-119123, grinding is temporarily stopped during the grinding process and the thickness of the disk-shaped workpiece is measured at totaling three points including a middle point of a radius of the disk-shaped workpiece (intermediate position between the center and an outer circumferential edge of the disk-shaped workpiece) and two points spaced by an equal distance from the middle point in a direction toward the center and a direction toward the outer circumference. Then, the relationship of an inclination (hereinafter referred to also as "inclination relationship") between a spindle shaft for rotating the grinding wheel and a table rotation shaft of a holding table for holding the disk-shaped workpiece is changed so as to eliminate the thickness difference of the disk-shaped workpiece at the three measurement points.

In the case where a disk-shaped workpiece ground to a uniform thickness is polished, a central portion of the disk-shaped workpiece with regard to which the time period for which a polishing pad contacts is long is polished by a greater amount and a disk-shaped workpiece having a shape in which the center is recessed shape is sometimes formed. Further, in a grinding and polishing apparatus in which the same holding table is used in grinding and polishing, the holding face of the holding table has a conical shape in which the center is a vertex. If the disk-shaped workpiece after grinding held by the holding table having a conical shape is polished, then the polishing pad is contacted strongly with a central portion of the disk-shaped workpiece, and therefore, the central portion is polished by a greater amount. As a countermeasure, as disclosed in Japanese Patent Laid-Open No. 2015-223636, the polishing face of a polishing pad is partially dressed to adjust the shape of the polishing face such that the center of the polishing face does not contact with the disk-shaped workpiece strongly thereby to uniformize the disk-shaped workpiece after polishing.

SUMMARY OF THE INVENTION

However, in polishing processing in which the polishing pad is pressed against a disk-shaped workpiece for a long period of time, there is a problem that, even if the polishing face of the polishing pad is dressed in a desired shape as disclosed in Japanese Patent Laid-Open No. 2015-223636, the polishing pad is crushed and the disk-shaped workpiece after polishing has a center recessed shape.

Further, there is a problem that, if the polishing pad becomes thin by dressing, then a cushion performance of the polishing pad is degraded and the polishing pad is pressed against a central portion of the disk-shaped workpiece held by the holding table and then the disk-shaped workpiece after polishing has a center recessed shape.

Therefore, it is an object of the present invention to provide a processing method capable of performing processing such that a disk-shaped workpiece after polishing has a uniform thickness.

In accordance with an aspect of the present invention, there is provided a processing method for a disk-shaped workpiece by which a disk-shaped workpiece held on a holding face of a holding table is polished with a polishing pad after the disk-shaped workpiece is ground with whetstones, including a holding step of causing the holding table to hold a disk-shaped workpiece, a grinding step of rotating a grinding wheel on which the whetstones are disposed and the disk-shaped workpiece to grind the disk-shaped workpiece with the whetstones, a polishing step of rotating, after the grinding step, the disk-shaped workpiece and the polishing pad in a state in which the polishing pad covers the disk-shaped workpiece to polish the disk-shaped workpiece, a measurement step of measuring, after the polishing step, a thickness of the disk-shaped workpiece at least at two measurement points of a first measurement point positioned on a center side of the disk-shaped workpiece and a second measurement point positioned at an outer circumferential edge side of the disk-shaped workpiece, a thickness tendency recognition step of recognizing a thickness tendency in a diametrical direction of the disk-shaped workpiece from a thicknesses of the disk-shaped workpiece at least at the two measurement points measured at the measurement step, and an inclination changing step of changing an inclination relationship between a rotation shaft for rotating the grinding wheel and a rotation shaft of the holding table on the basis of the thickness tendency recognized at the thickness tendency recognition step.

Preferably, the processing method for a disk-shaped workpiece may be configured such that, at the measurement step, the thickness of the disk-shaped workpiece is measured at least at three measurement points of the two measurement points and a third measurement point that is an intermediate point between the first measurement point and the second measurement point, and at the thickness tendency recognition step, a thickness tendency in a diametrical direction of the disk-shaped workpiece is recognized from the thicknesses of the disk-shaped workpiece at least at the three measurement points.

Preferably, the processing method for a disk-shaped workpiece further includes a pre-polishing measurement step of measuring, before the polishing step, the thickness of the disk-shaped workpiece at least at the two measurement points of the first measurement point and the second measurement point, and a calculation step of subtracting, before the inclination changing step, the thicknesses of the disk-shaped workpiece at least at the two measurement points measured at the measurement step from the thicknesses of the disk-shaped workpiece at least at the two measurement points measured at the pre-polishing measurement step to calculate a polishing removal amount at least at the two measurement points. At the inclination changing step, the inclination relationship between the rotation shaft for rotating the grinding wheel and the rotation shaft of the holding table is changed on the basis of the thickness tendency recognized at the thickness tendency recognition step and the polishing removal amount.

Preferably, the processing method for a disk-shaped workpiece is configured such that, at the pre-polishing measurement step, the thickness of the disk-shaped workpiece at least at the three measurement points of the two measurement points and a third measurement point that is an intermediate point between the first measurement point and the second measurement point; at the measurement step, the thickness of the disk-shaped workpiece is measured at least at the three measurement points; at the calculation step, the thicknesses of the disk-shaped workpiece at least at the three measurement points measured at the measurement step are subtracted from the thicknesses of the disk-shaped workpiece at least at the three measurement points measured at the pre-polishing measurement step to calculate a polishing removal amount at least at the three measurement points; and at the thickness tendency recognition step, the thickness tendency in a diametrical direction of the disk-shaped workpiece is recognized from the thicknesses of the disk-shaped workpiece at least at the three measurement points.

Since the processing method for a disk-shaped workpiece according to the present invention includes the measurement step of measuring the thickness of the disk-shaped workpiece at least at two measurement points of the first measurement point positioned on the center side of the disk-shaped workpiece and the second measurement point positioned at the outer circumferential edge side of the disk-shaped workpiece, the thickness tendency recognition step of recognizing a thickness tendency (for example, a tendency toward a center recessed shape) in a diametrical direction of the disk-shaped workpiece from the thicknesses of the disk-shaped workpiece at least at the two measurement points measured at the measurement step, and the inclination changing step of changing the inclination relationship between the rotation shaft for rotating the grinding wheel and the rotation shaft of the holding table on the basis of the thickness tendency recognized at the thickness tendency recognition step, it becomes possible to flatten a new disk-shaped workpiece, for which polishing processing is to be performed next, with high accuracy in comparison with the disk-shaped workpiece subjected to the polishing processing last.

It is to be noted that, during the grinding and polishing processing, dressing of the polishing pad is performed periodically, a phenomenon that, if the dressing is repetitively performed and the thickness of the polishing pad become thin, the polishing pad is liable to obtain a center recessed shape. However, with the processing method for a disk-shaped workpiece according to the present invention, even in the case where dressing is performed periodically for the polishing pad, a new disk-shaped workpiece for which polishing processing is to be performed next can be flattened with high accuracy in comparison with a disk-shaped workpiece subjected to the polishing processing last.

In the case where the processing method for a disk-shaped workpiece is configured such that, at the measurement step, the thickness of the disk-shaped workpiece is measured at least at three measurement points of the two measurement points and a third measurement point that is an intermediate point between the first measurement point and the second measurement point, and at the thickness tendency recognition step, a thickness tendency in a diametrical direction of the disk-shaped workpiece is recognized from the thicknesses of the disk-shaped workpiece at least at the three measurement points, when the inclination relationship between the rotation shaft for rotating the grinding wheel and the rotation shaft of the holding table is to be changed at the inclination changing step, the inclination relationship can be changed more appropriately that where the number of measurement points is two.

In the case where the processing method for a disk-shaped workpiece further includes a pre-polishing measurement step of measuring, before the polishing step, the thickness of the disk-shaped workpiece at least at the two measurement points of the first measurement point and the second measurement point, and a calculation step of subtracting, before the inclination changing step, the thicknesses of the disk-shaped workpiece at least at the two measurement points measured at the measurement step from the thicknesses of the disk-shaped workpiece at least at the two measurement points measured at the pre-polishing measurement step to calculate a polishing removal amount at least at the two measurement points. At the inclination changing step, the inclination relationship between the rotation shaft for rotating the grinding wheel and the rotation shaft of the holding table on the basis of the thickness tendency recognized at the thickness tendency recognition step and the polishing removal amount, a new disk-shaped workpiece for which polishing processing is to be performed next can be flattened with high accuracy in comparison with a disk-shaped workpiece subjected to the polishing processing last.

Further, in the case where the processing method for a disk-shaped workpiece is configured such that, at the pre-polishing measurement step, the thickness of the disk-shaped workpiece is measured at least at the three measurement points of the two measurement points and a third measurement point that is an intermediate point between the first measurement point and the second measurement point; at the measurement step, the thickness of the disk-shaped workpiece is measured at least at the three measurement points; at the calculation step, the thicknesses of the disk-shaped workpiece at least at the three measurement points measured at the measurement step are subtracted from the thicknesses of the disk-shaped workpiece at least at the three measurement points measured at the pre-polishing measurement step to calculate a polishing removal amount at least at the three measurement points; and at the thickness tendency recognition step, the thickness tendency in a diametrical direction of the disk-shaped workpiece is recognized from the thicknesses of the disk-shaped workpiece at least at the three measurement points, when the inclination relationship between the rotation shaft for rotating the grinding wheel and the rotation shaft of the holding table is to be changed at the inclination changing step, the inclination relationship can be changed more appropriately that where the number of measurement points is two.

The above and other objects, features and advantages of the present invention and the manner of realizing them will become more apparent, and the invention itself will best be understood from a study of the following description and appended claims with reference to the attached drawings showing preferred embodiments of the invention.

DETAILED DESCRIPTION OF THE PREFERRED EMBODIMENTS

Figure 1:
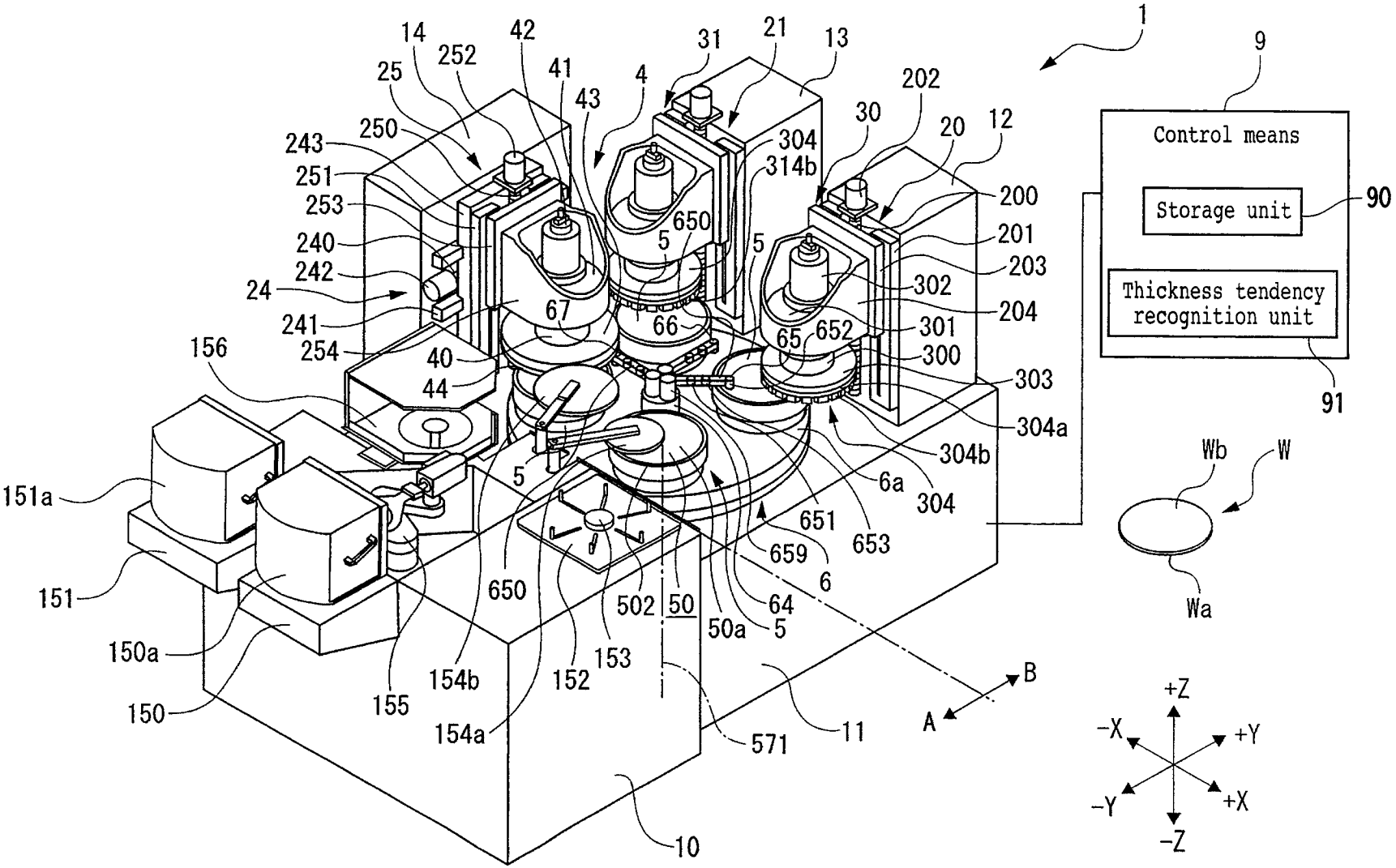
FIG. 1 is a perspective view depicting an example of a grinding and polishing apparatus.

A grinding and polishing apparatus 1 depicted in FIG. 1 includes rough grinding means 30, finish grinding means 31, and polishing means 4 and is an apparatus in which a disk-shaped workpiece W held on one of holding tables 5 is ground by the rough grinding means 30 and the finish grinding means 31 and is further polished by the polishing means 4.

The grinding and polishing apparatus 1 is configured such that a second apparatus base 11 is connected to the rear (+Y direction side) of a first apparatus base 10. An upper face of the first apparatus base 10 forms a carry-in/out region A to and from which carrying-in and carrying-out of the disk-shaped workpiece W are to be performed. An upper face of the second apparatus base 11 forms a processing region B in which a disk-shaped workpiece W held by a holding table 5 is processed by the rough grinding means 30, the finish grinding means 31, or the polishing means 4.

The disk-shaped workpiece W depicted in FIG. 1 is a circular semiconductor wafer made of, for example, silicon base material, and a front face Wa of the disk-shaped workpiece W that is directed downwardly in FIG. 1 has a plurality of devices formed thereon and a protective tape not depicted is adhered to the front face Wa of the disk-shaped workpiece W to protect the plurality of devices. A rear face Wb of the disk-shaped workpiece W serves as a processing target face to be subjected to grinding processing and polishing processing. It is to be noted that the disk-shaped workpiece W may be configured not from silicon but from gallium arsenide, sapphire, gallium nitride, silicon carbide or the like.

On the front face (−Y direction side) of the first apparatus base 10, a first cassette placement unit 150 and a second cassette placement unit 151 are provided, and a first cassette 150*a* in which a disk-shaped workpiece W before processing is to be accommodated is placed on the first cassette placement unit 150 while a second cassette 151*a* in which a disk-shaped workpiece W after processing is to be accommodated is placed on the second cassette placement unit 151.

Behind an opening on the +Y direction side of the first cassette 150*a*, a robot 155 is disposed which carries out a disk-shaped workpiece W before processing from the first cassette 150*a* and carries in a disk-shaped workpiece W after processing to the second cassette 151*a*. At a position adjacent the robot 155, a temporary placement region 152 is provided, and in the temporary placement region 152, positioning means 153 is disposed. The positioning means 153 performs positioning (centering) of a disk-shaped workpiece W carried out from the first cassette 150*a* and placed in the temporary placement region 152 to a predetermined position by positioning pins that move so as to reduce a space defined by them.

At a position adjacent the positioning means 153, a loading arm 154*a* is disposed which pivots in a state in which it holds a disk-shaped workpiece W thereon. The loading arm 154*a* holds a disk-shaped workpiece W positioned by the positioning means 153 and transports the disk-shaped workpiece W to one of the holding tables 5 disposed in the processing region B. Adjacent the loading arm 154*a*, an unloading arm 154*b* is provided which pivots in a state in which it holds a disk-shaped workpiece W after processing. At a position in the neighborhood of the unloading arm 154*b*, single wafer type cleaning means 156 is disposed which cleans a disk-shaped workpiece W after processing transported thereto by the unloading arm 154*b*. The disk-shaped workpiece W washed by the cleaning means 156 is carried into the second cassette 151*a* by the robot 155.

On the rear (+Y direction side) on the second apparatus base 11, a first column 12 is provided uprightly, and rough grinding feeding means 20 is provided on the front face of the first column 12. The rough grinding feeding means 20 is configured from a ball screw 200 having an axis in the vertical direction (Z axis direction), a pair of guide rails 201 disposed in parallel to the ball screw 200, a motor 202 that is connected to the ball screw 200 and rotates the ball screw 200, a lifting plate 203 screwed at an internal nut thereof with the ball screw 200 and slidably contacting at side portions thereof with the guide rails 201, and a holder 204 connected to the lifting plate 203 and holding the rough grinding means 30 thereon. If the motor 202 rotates the ball screw 200, then the lifting plate 203 is moved back and forth in the Z axis direction by the rotation of the motor 202 under the guidance of the guide rails 201, and also the rough grinding means 30 supported on the holder 204 is moved back and forth in the Z axis direction.

The rough grinding means 30 includes a rotation shaft 300 having an axial direction coincident with the vertical direction (Z axis direction), a housing 301 that supports the rotation shaft 300 for rotation thereon, a motor 302 for driving the rotation shaft 300 to rotate, a circular mount 303 connected to a lower end of the rotation shaft 300, and a grinding wheel 304 removably connected to a lower face of the mount 303. Further, the grinding wheel 304 includes a wheel base 304*a*, and a plurality of rough grinding whetstones 304*b* of a substantially parallelepiped shape disposed annularly on a bottom face of the wheel base 304*a*. The rough grinding whetstones 304*b* are whetstones in which abrasive grains of a comparatively great are included.

For example, a grinding water flow path extending in the Z axis direction is formed in the inside of the rotation shaft 300, and grinding water supply means not depicted is communicated with the grinding water flow path. Grinding water supplied from the grinding water supply means to the rotation shaft 300 is jetted downwardly from an opening at the lower end of the grinding water flow path toward the rough grinding whetstones 304*b* and comes to a contacting region between the rough grinding whetstones 304*b* and a disk-shaped workpiece W.

Further, in the rear on the second apparatus base 11, a second column 13 is provided uprightly in a juxtaposed relationship in the X axis direction with the first column 12, and finish grinding feeding means 21 is provided on a front face of the second column 13. The finish grinding feeding means 21 is configured similarly to the rough grinding feeding means 20 and can grinding feed the finish grinding means 31 in the Z axis direction. The finish grinding means 31 includes a finish grinding wheel 314*b* in which abrasive grains of a comparatively small size are included and is similar in configuration of the other part to the rough grinding means 30.

On one side (−X direction side) on the second apparatus base 11, a third column 14 is provided uprightly, and Y axis direction moving means 24 is provided on a front face of the third column 14. The Y axis direction moving means 24 is configured from a ball screw 240 having an axis in the Y axis direction, a pair of guide rails 241 disposed in parallel to the ball screw 240, a motor 242 for rotating the ball screw 240, and a movable plate 243 screwed at an internal nut thereof with the ball screw 240 and slidably contacting at side portions thereof with the guide rails 241. Thus, if the motor 242 rotates the ball screw 240, then the movable plate 243 is moved in the Y axis direction under the guidance of the guide rails 241 by the rotation of the ball screw 240, and the polishing means 4 provided on the movable plate 243 is moved in the Y axis direction together with the rotation of the movable plate 243.

Polishing feeding means 25 that moves the polishing means 4 upwardly and downwardly in the Z axis direction to move the polishing means 4 toward and away from the holding table 5 is provided on the movable plate 243. The polishing feeding means 25 is configured from a ball screw 250 having an axis in the vertical direction, a pair of guide rails 251 disposed in parallel to the ball screw 250, a motor 252 that is connected to the ball screw 250 and rotates the ball screw 250, a lifting plate 253 that is screwed at an internal nut thereof with the ball screw 250 and slidably contacting at side portions thereof with the guide rails 251, and a holder 254 connected to the lifting plate 253 and holding the polishing means 4 thereon. If the motor 252 rotates the ball screw 250, then the lifting plate 253 is moved in the Z axis direction under the guidance of the guide rails 251 and also the polishing means 4 supported on the holder 254 is moved in the Z axis direction.

The polishing means 4 is configured from a rotation shaft 40 having an axial direction, for example, in the vertical direction, a housing 41 that supports the rotation shaft 40 for rotation, a motor 42 that drives the rotation shaft 40 to rotate, a disk-shaped mount 43 fixed to a lower end of the rotation shaft 40, and a circular polishing pad 44 removably attached to a lower face of the mount 43. The polishing pad 44 is made of non-woven fabric such as, for example, felt and has formed at a central portion thereof a through-hole through which slurry (polishing liquid including loose abrasive grains) is to pass. The diameter of the polishing pad 44 is a size substantially equal to the diameter of the mount 43 and is greater than the diameter of the holding table 5.

A slurry flow path is formed in the inside of the rotation shaft 40 such that it extends in the axial direction, and slurry supply means not depicted is connected to the slurry flow path. Slurry supplied from the slurry supply means to the rotation shaft 40 is jetted from an opening at a lower end of the slurry flow path toward the polishing pad 44, passes through the through-hole of the polishing pad 44 and comes to the contacting region between the polishing pad 44 and the disk-shaped workpiece W.

As depicted in FIG. 1, a turntable 6 is disposed on the second apparatus base 11, and four holding tables 5 are disposed, for example, in an equally spaced relationship in a circumferential direction on an upper face of the turntable 6. An air supply source not depicted for supplying air is connected to a lower face side of the turntable 6. By blowing air supplied by the air supply source toward the lower face of the turntable 6, the turntable 6 can be lifted so as to be placed into a rotatable state around the axis in the Z axis direction. Further, a rotation shaft not depicted for rotating the turntable 6 is provided at the center of the turntable 6 such that the turntable 6 can rotate around the rotation shaft and around the axis in the Z axis direction. By the rotation of the turntable 6, the four holding tables 5 can be revolved such that each holding table 5 can be sequentially positioned from a position in the proximity of the temporary placement region 152 to a position below the rough grinding means 30, a position below the finish grinding means 31, and below the polishing means 4.

As depicted in FIG. 1, the holding table 5 includes a porous member 50 at an upper portion thereof, and the porous member 50 is surrounded and supported by a frame body 502 and is connected to a suction source not depicted. An upper face of the porous member 50 forms a holding face 50*a* that holds the front face Wa of a disk-shaped workpiece W and is formed in a conical face shape having a vertex at the center of rotation of the porous member 50 and having a very moderate slope. Also the disk-shaped workpiece W is held following the conical face shape holding face 50*a*. It is to be noted that the slope of the holding face 50*a* is so moderate that it cannot be recognized by the naked eye.

Figure 2:
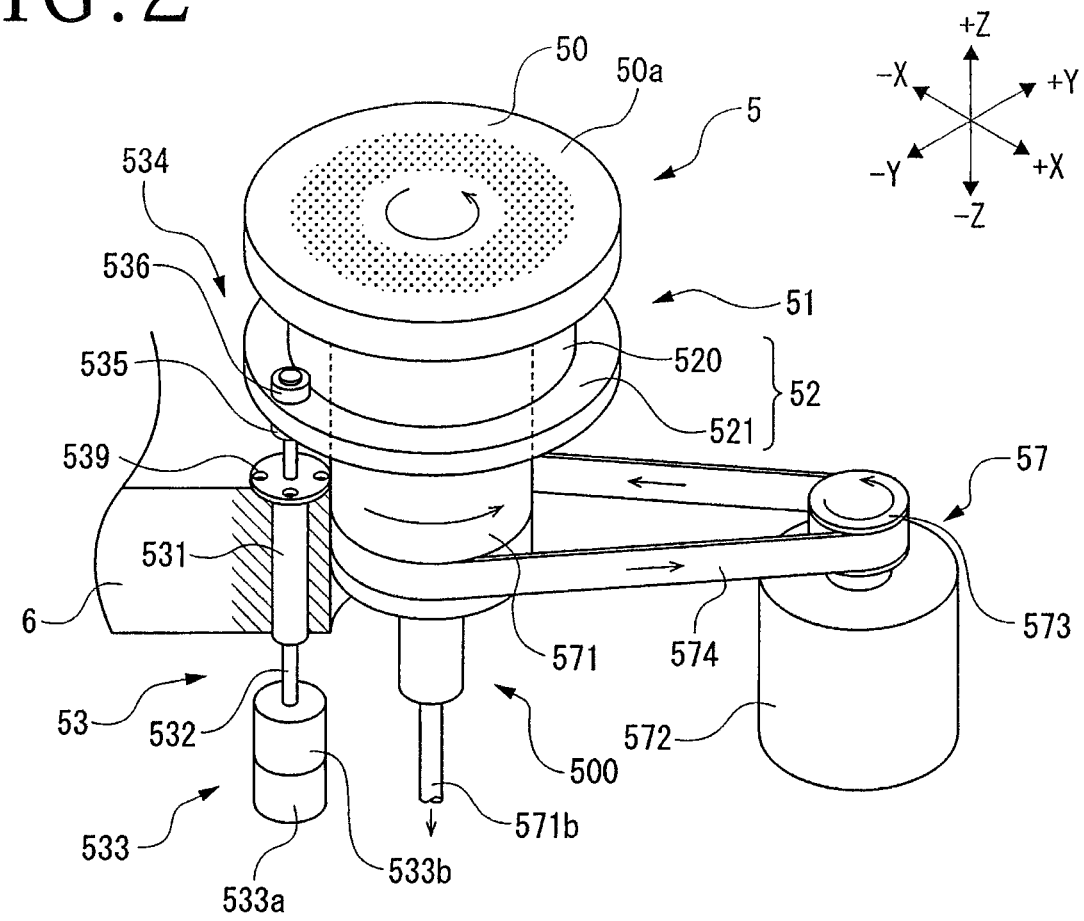
FIG. 2 is a perspective view depicting a position adjustment unit, a holding table, and holding table rotation means.

The holding table 5 is rotatable around the center provided by a rotation shaft 571 passing the center of the holding face 50*a*. As depicted in FIG. 2, a pipe 571*b* is provided on the rotation shaft 571 such that it extends through the rotation shaft 571, and is connected to a suction source not depicted that generates suction force for the holding face 50*a*.

The holding table 5 is rotatable by holding table rotating means 57 depicted in FIG. 2. The holding table rotating means 57 is a pulley mechanism that includes, for example, the rotation shaft 571 described above, and a motor 572 serving as a driving source for rotating the holding table 5 around an axis provided by the center of the holding table 5. A pulley 573 is attached to a shaft of the motor 572, and an endless belt 574 is wrapped around the pulley 573. The endless belt 574 is wrapped also around the rotation shaft 571. If the motor 572 drives the pulley 573 to rotate, then the endless belt 574 is turned by the rotation of the pulley 573, and the turning of the endless belt 574 rotates the rotation shaft 571 and the holding table 5.

As depicted in FIG. 2, each of the holding tables 5 includes inclination changing means 51 for adjusting the inclination of the rotation shaft 571.

The inclination changing means 51 is configured from a support base 52 and a position adjustment unit 53 connected to the support base 52. The support base 52 is configured from a supporting cylindrical portion 520 formed cylindrically and a flange portion 521 having an increased diameter from that of the supporting cylindrical portion 520. The support base 52 surrounds an upper portion side of the rotation shaft 571 and supports the rotation shaft 571 of the holding table 5 for rotation through a bearing not depicted provided in the inside thereof. The inclination changing means 51 has a function for adjusting the inclination of the rotation shaft 571, namely, the inclination of the holding face 50*a*, by adjusting the inclination of the flange portion 521.

Figure 3:
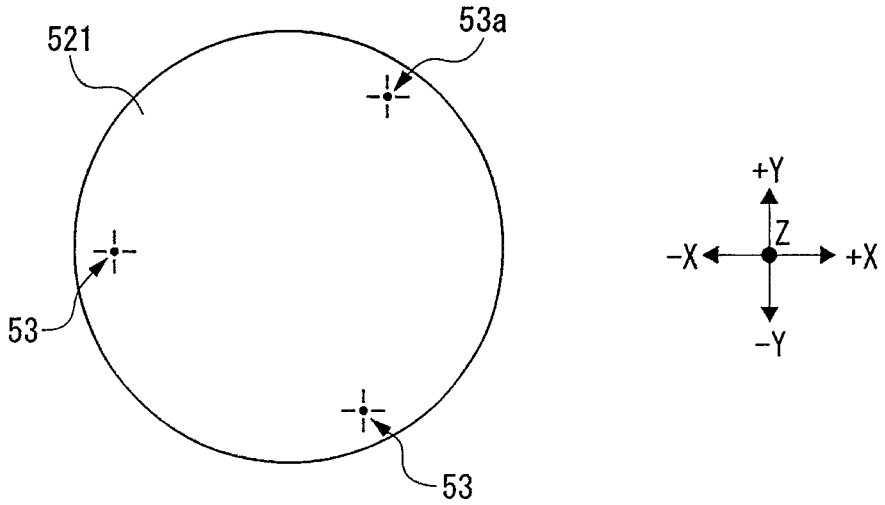
FIG. 3 is an explanatory view of an arrangement example of the position adjustment unit that configures inclination adjustment means.

As depicted in FIG. 2, two or more position adjustment units 53 are provided in an equally spaced relationship in a circumferential direction on the flange portion 521. For example, as depicted in FIG. 3, two position adjustment units 53 and a fixing unit 53*a* for fixing the flange portion 521 are disposed at distances of 120 degrees. Further, three or more position adjustment units 53 may be disposed.

Figure 4:
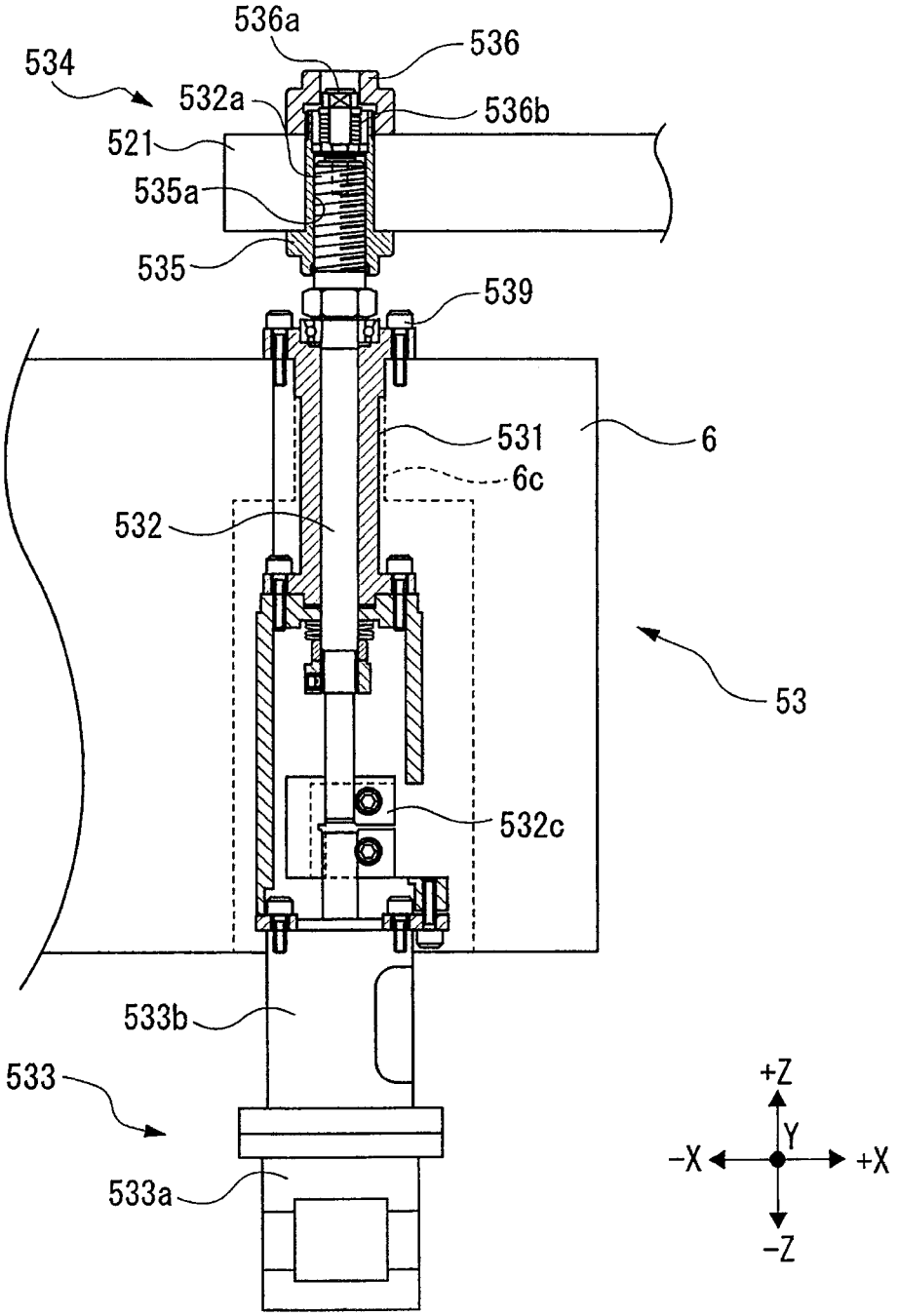
FIG. 4 is a sectional view depicting an example of the position adjustment unit.

As depicted in FIGS. 2 and 4, the position adjustment unit 53 is configured from a tubular portion 531 fixed to the turntable 6 by screws 539, a shaft 532 extending through the tubular portion 531, a driving unit 533 connected to a lower end of the shaft 532, and a fixing portion 534 fixed to the flange portion 521 at an upper end of the shaft 532. The driving unit 533 is configured from a motor 533*a* for rotating the shaft 532 and a speed reducer 533*b* for reducing the speed of rotation of the shaft 532.

As depicted in FIG. 4, a first male thread 532*a* is formed at an upper end portion of the shaft 532. On the other hand, the fixing portion 534 is configured from a nut 535 having a first female thread 535*a* that is screwed with the first male thread 532*a* and a nut 536 fixed to the nut 535 by a bolt 536*a*, and the flange portion 521 is secured by and between the nut 535 and the nut 536. A spring 536*b* is interposed between the bolt 536*a* and the shaft 532.

The tubular portion 531 is supported at a hole 6*c* formed in the turntable 6. Further, the speed reducer 533*b* and the motor 533*a* are connected to a lower end portion of the shaft 532 through a coupling 532*c* such that the shaft 532 can be driven to rotate by the motor 533*a*. As a result, the inclination of the flange portion 521 can be changed.

For example, as depicted in FIG. 1, a cylindrical support base 64 is provided at the center of the turntable 6, and rough grinding thickness measurement means 65, finish grinding thickness measurement means 66, and polishing thickness measurement means 67 are disposed on the support base 64. Since the rough grinding thickness measurement means 65, the finish grinding thickness measurement means 66, and the polishing thickness measurement means 67 have configurations similar to each other, the configuration of the rough grinding thickness measurement means 65 is described below.

The rough grinding thickness measurement means 65 includes an arm 650 extending in parallel (horizontally) to an upper face of the second apparatus base 11. The arm 650 can be pivotally moved horizontally by moving means 659 fixed to the support base 64.

The arm 650 has an optical sensor 652, another optical sensor 653, and a further optical sensor 651 disposed linearly in an equally spaced and lined up state from each other thereon.

As depicted in FIG. 1, the grinding and polishing apparatus 1 includes control means 9 that controls, for example, the entire apparatus. The control means 9 includes a central processing unit (CPU) that performs arithmetic operation processing in accordance with a control program and a storage unit 90 such as a memory and is electrically connected to the rough grinding feeding means 20, the finish grinding feeding means 21, the rough grinding means 30, the finish grinding means 31, the holding table rotating means 57 (FIG. 2) and so forth. Thus, grinding feeding operation of the rough grinding means 30 (finish grinding means 31) in the Z axis direction by the rough grinding feeding means 20 (finish grinding feeding means 21), rotating operation of the grinding wheel 304 by the rough grinding means 30 (finish grinding means 31), rotating operation of the holding table 5 by the holding table rotating means 57 and so forth are performed under the control of the control means 9.

Embodiment 1 of Processing Method

Figure 5:
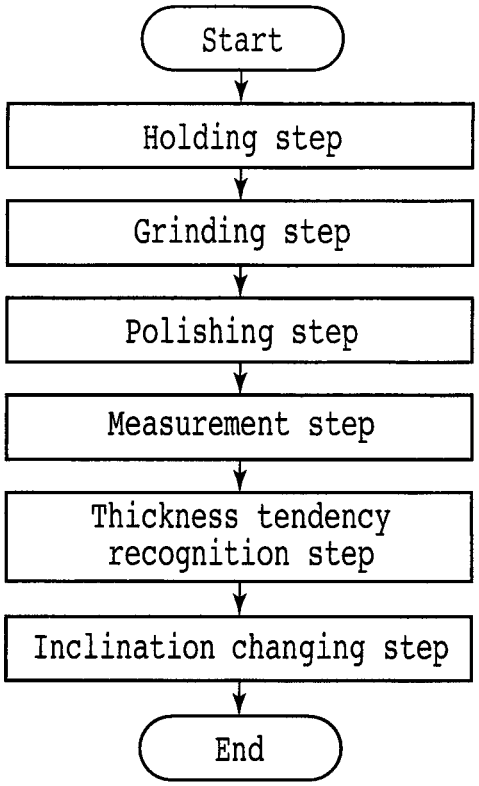
FIG. 5 is a flow chart illustrating a flow of steps of a processing method for a disk-shaped workpiece of an embodiment 1.

In the following, steps in the case where grinding processing and polishing processing are performed for a disk-shaped workpiece W using the grinding and polishing apparatus 1 depicted in FIG. 1 are described. The steps of the processing method for a disk-shaped workpiece according to the present embodiment (hereinafter referred to as processing method of the embodiment 1) are carried out in an order depicted, for example, in a flow chart of FIG. 5.

(1) Holding Step

Figure 6:
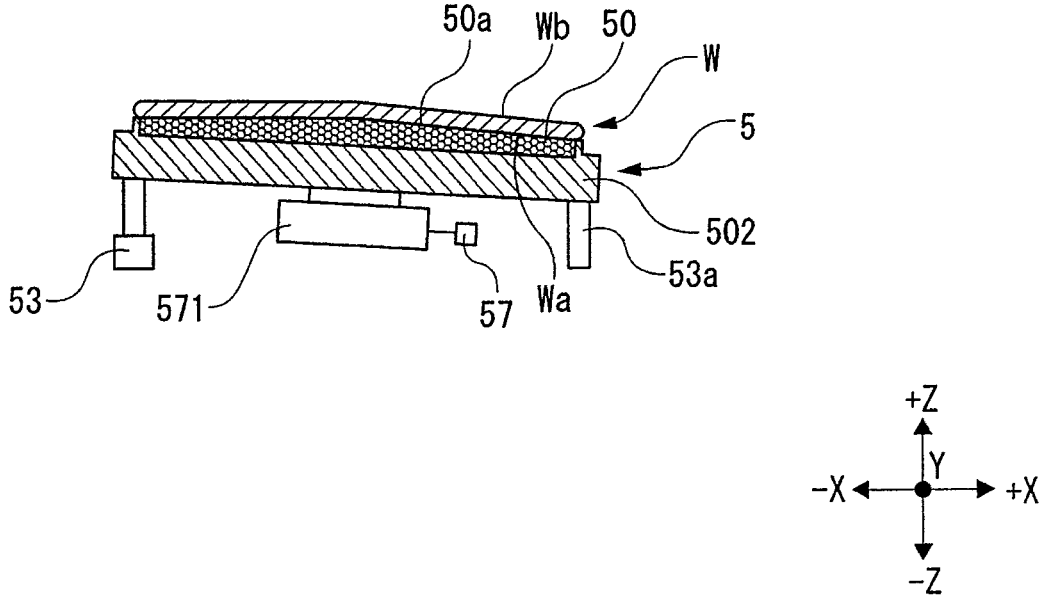
FIG. 6 is a sectional view illustrating a state in which a disk-shaped workpiece is held on the holding table.

First, the turntable 6 depicted in FIG. 1 rotates to revolve a holding table 5 that is in a state in which it does not have a disk-shaped workpiece W placed thereon until the holding table 5 is moved to the proximity of the loading arm 154*a*. The robot 155 pulls out one disk-shaped workpiece W from the first cassette 150*a* and moves the disk-shaped workpiece W to the temporary placement region 152. Then, after the disk-shaped workpiece W is centered by the positioning means 153, the loading arm 154*a* moves the centered disk-shaped workpiece W to the holding table 5. Then, the disk-shaped workpiece W is placed on the holding face 50*a* in a state in which the rear face Wb thereof is directed upwardly such that the center of the holding table 5 and the center of the disk-shaped workpiece W are substantially matched as depicted in FIG. 6. It is to be noted that, in FIG. 6, the configuration of the inclination changing means 51, the holding table rotating means 57 and so forth is depicted in a simplified form.

Then, suction force generated by operation of the suction source not depicted is transmitted to the holding face 50*a* through the pipe 571*b* depicted in FIG. 2 to hold the disk-shaped workpiece W by the holding table 5. Further, the inclination of the holding table 5 (inclination of the rotation shaft 571) is adjusted by the inclination changing means 51 depicted in FIG. 2 such that the holding face 50*a* having a moderate conical face shape lies substantially in parallel to the grinding face (lower face) of the rough grinding whetstones 304*b* of the rough grinding means 30 depicted in FIG. 1. By such adjustment, part of the rear face Wb of the disk-shaped workpiece W sucked to and held by the holding face 50*a* of the conical face shape lies substantially in parallel to the grinding face of the rough grinding whetstones 304*b* as depicted in FIG. 7.

(2) Grinding Step

The turntable 6 depicted in FIG. 1 rotates in the counterclockwise direction as viewed in the +Z direction to revolve the holding table 5 in a state in which the disk-shaped workpiece W is sucked and held to perform positioning between the rough grinding whetstones 304*b* of the rough grinding means 30 and the disk-shaped workpiece W held on the holding table 5. The positioning is performed such that, for example, as depicted in FIGS. 7 and 8, the center of rotation of the rough grinding whetstones 304*b* is displaced by a predetermined distance in the horizontal direction from the center of rotation of the disk-shaped workpiece W such that the locus of rotation of the rough grinding whetstones 304*b* passes the center of rotation of the disk-shaped workpiece W.

Figure 7:
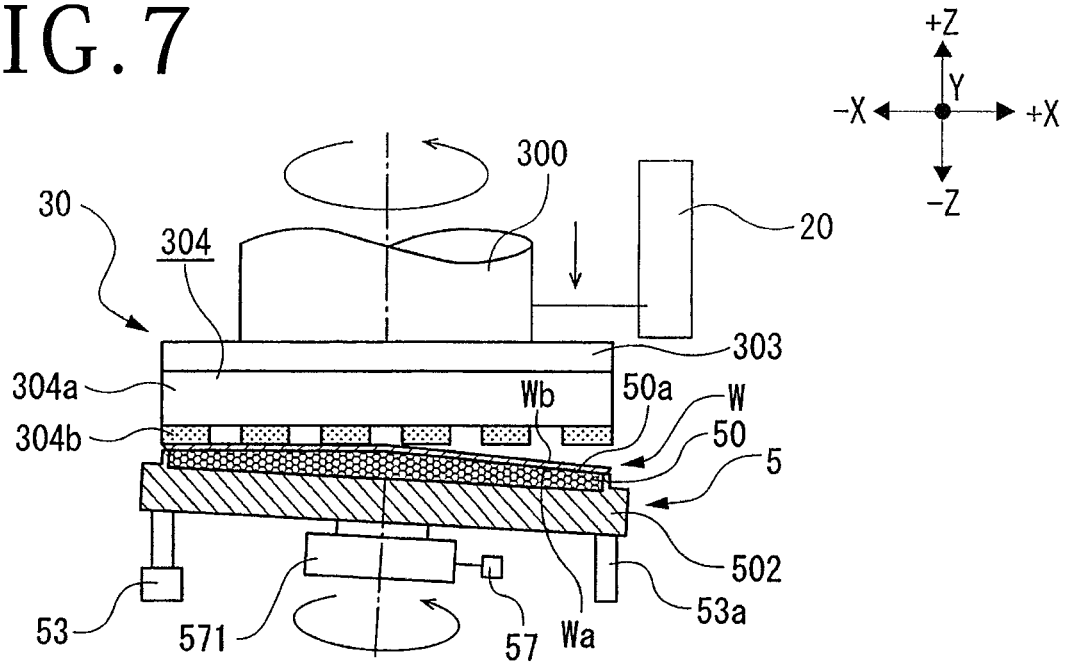
FIG. 7 is a sectional view illustrating a state in which a disk-shaped workpiece and a grinding wheel are rotated and the disk-shaped workpiece is ground with whetstones.

As depicted in FIG. 7, when the rotation shaft 300 is rotated at a predetermined rotational speed by the motor 302, the rough grinding whetstones 304*b* rotates. Further, the rough grinding means 30 is fed in the −Z direction by the rough grinding feeding means 20 and the rotating rough grinding whetstones 304*b* is contacted with the rear face Wb of the disk-shaped workpiece W held on the holding table 5 to perform grinding processing. Further, when the holding table rotating means 57 rotates the holding table 5 at a predetermined rotational speed, since also the disk-shaped workpiece W held on the holding face 50*a* rotates, the rough grinding whetstones 304*b* perform rough grinding processing of the overall rear face Wb of the disk-shaped workpiece W. During the rough grinding processing, the grinding water supply means not depicted supplies grinding water to the contacting region between the rough grinding whetstones 304*b* and the rear face Wb of the disk-shaped workpiece W through the grinding water flow path in the rotation shaft 300 to cool and wash the contacting region.

Figure 8:
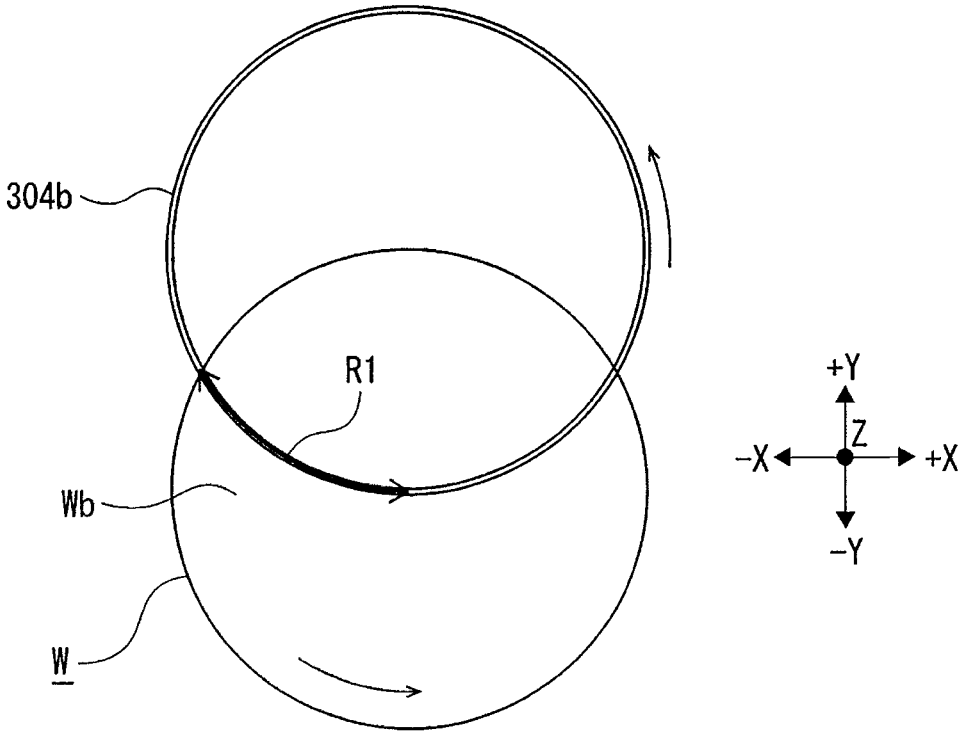
FIG. 8 is an explanatory view in the case where a processing region of a disk-shaped workpiece by the whetstones during grinding processing is viewed from above.

Since the disk-shaped workpiece W is sucked and held in a manner following the holding face 50*a* of the moderate conical face shape of the holding table 5, the rough grinding whetstones 304*b* contacts with and grinds the disk-shaped workpiece W within a range indicated by an arrow mark R1 in the locus of rotation of the rough grinding whetstones 304*b* as depicted in FIG. 8.

After the disk-shaped workpiece W is roughly ground to a depth before the finish thickness, the rough grinding feeding means 20 depicted in FIG. 7 moves up the rough grinding means 30 so as to be spaced away from the disk-shaped workpiece W. Then, the turntable 6 depicted in FIG. 1 rotates in the counterclockwise direction as viewed in the +Z direction until the holding table 5 that sucks and holds the disk-shaped workpiece W comes to a position below the finish grinding means 31.

After positioning between the finish grinding wheel 314*b* of the finish grinding means 31 depicted in FIG. 1 and the disk-shaped workpiece W sucked to and held by the holding table 5 is performed similarly as in the case of rough grinding processing, the finish grinding means 31 is fed downwardly by the finish grinding feeding means 21 until the rotating finish grinding wheel 314*b* is brought into contact with the rear face Wb of the disk-shaped workpiece W. Then, as the holding table 5 rotates, the disk-shaped workpiece W held on the holding face 50*a* rotates to perform finish grinding of the overall rear face Wb of the disk-shaped workpiece W. Further, grinding water is supplied to the contacting region of the finish grinding wheel 314*b* and the disk-shaped workpiece W to cool and wash the contacting region. It is to be noted that the inclination of the holding table 5 (inclination of the rotation shaft 571) is similar to that upon rough grinding.

(3) Polishing Step

Figure 9:
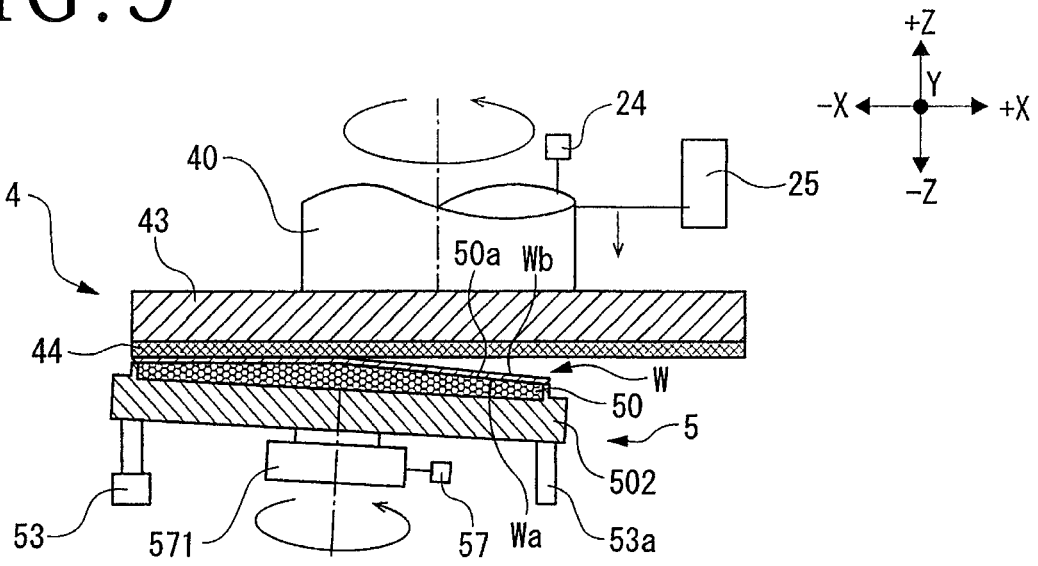
FIG. 9 is a sectional view illustrating a state in which polishing is performed in a state in which a disk-shaped workpiece and a polishing pad are rotated and the polishing pad covers the disk-shaped workpiece.
Figure 10:
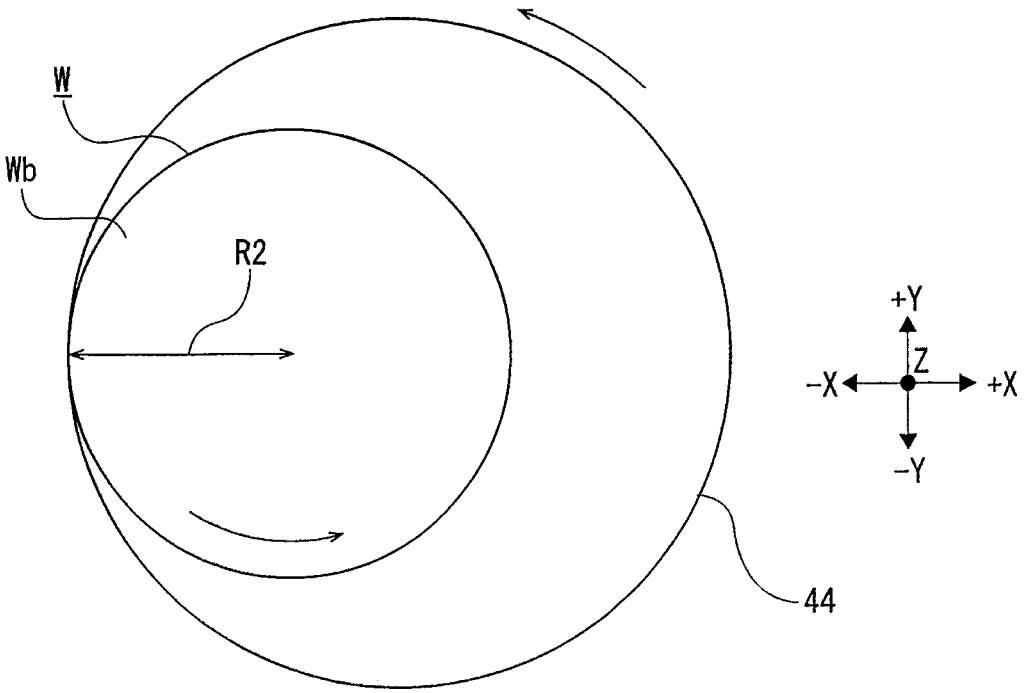
FIG. 10 is an explanatory view in the case where a working region of a disk-shaped workpiece by the polishing pad during polishing processing is viewed from below.

After the finish grinding wheel 314*b* is spaced away from the disk-shaped workpiece W ground to a desired finish thickness (for example, 100 μm) and having increased flatness of the rear face Wb, the turntable 6 depicted in FIG. 1 rotates in the counterclockwise direction as viewed from the +Z direction to revolve the holding table 5 holding the disk-shaped workpiece W after the finish grinding such that the holding table 5 is positioned to a predetermined polishing processing position at which the polishing means 4 is to polish the disk-shaped workpiece W. The positioning of the disk-shaped workpiece W with respect to the polishing pad 44 of the polishing means 4 is performed such that, for example, as depicted in FIGS. 9 and 10, the center of rotation of the polishing pad 44 is displaced in the horizontal direction by a predetermined distance with respect to the center of rotation of the disk-shaped workpiece W and the polishing pad 44 covers the overall rear face Wb of the disk-shaped workpiece W. It is to be noted that, although, in the example depicted in FIGS. 9 and 10, part of an outer circumference of the polishing pad 44 and part of an outer circumference of the disk-shaped workpiece W overlap with each other as viewed from the +Z direction, this state is not restrictive.

As depicted in FIG. 9, as the rotation shaft 40 is driven to rotate by the motor 42, the polishing pad 44 rotates. Further, the polishing means 4 is fed in the −Z direction by the polishing feeding means 25 until the polishing pad 44 is brought into contact with the rear face Wb of the disk-shaped workpiece W to perform polishing processing. Further, as the holding table rotating means 57 rotates the holding table 5 at a predetermined speed of rotation, also the disk-shaped workpiece W held on the holding face 50*a* rotates, and therefore, the polishing pad 44 performs polishing processing of the overall rear face Wb of the disk-shaped workpiece W. Further, during the polishing processing, slurry is supplied to the contacting region of the polishing pad 44 and the rear face Wb of the disk-shaped workpiece W.

Since the disk-shaped workpiece W is sucked and held following the holding face 50*a* of the moderate conical face shape of the holding table 5, the polishing pad 44 contacts with and polishes the disk-shaped workpiece W within a range indicated by an arrow mark R2 from within the polishing face of the polishing pad 44 as depicted in FIG. 10.

It is to be noted that, in the case where the polishing means 4 is not moved in a plane direction (horizontal direction) of the disk-shaped workpiece W during polishing processing, a striped pattern is sometimes formed on the rear face Wb, and this makes a factor of decreasing the folding strength of the disk-shaped workpiece W. Therefore, during polishing processing, the Y axis direction moving means 24 may move the polishing means 4 back and forth in the Y axis direction to slidably move the polishing pad 44 on the rear face Wb of the disk-shaped workpiece W.

After polishing of one disk-shaped workpiece W is completed, the polishing means 4 is moved in the +Z direction by the polishing feeding means 25 depicted in FIG. 9 so as to be spaced away from the disk-shaped workpiece W after the polishing processing.

(4) Measurement Step

Figure 11:
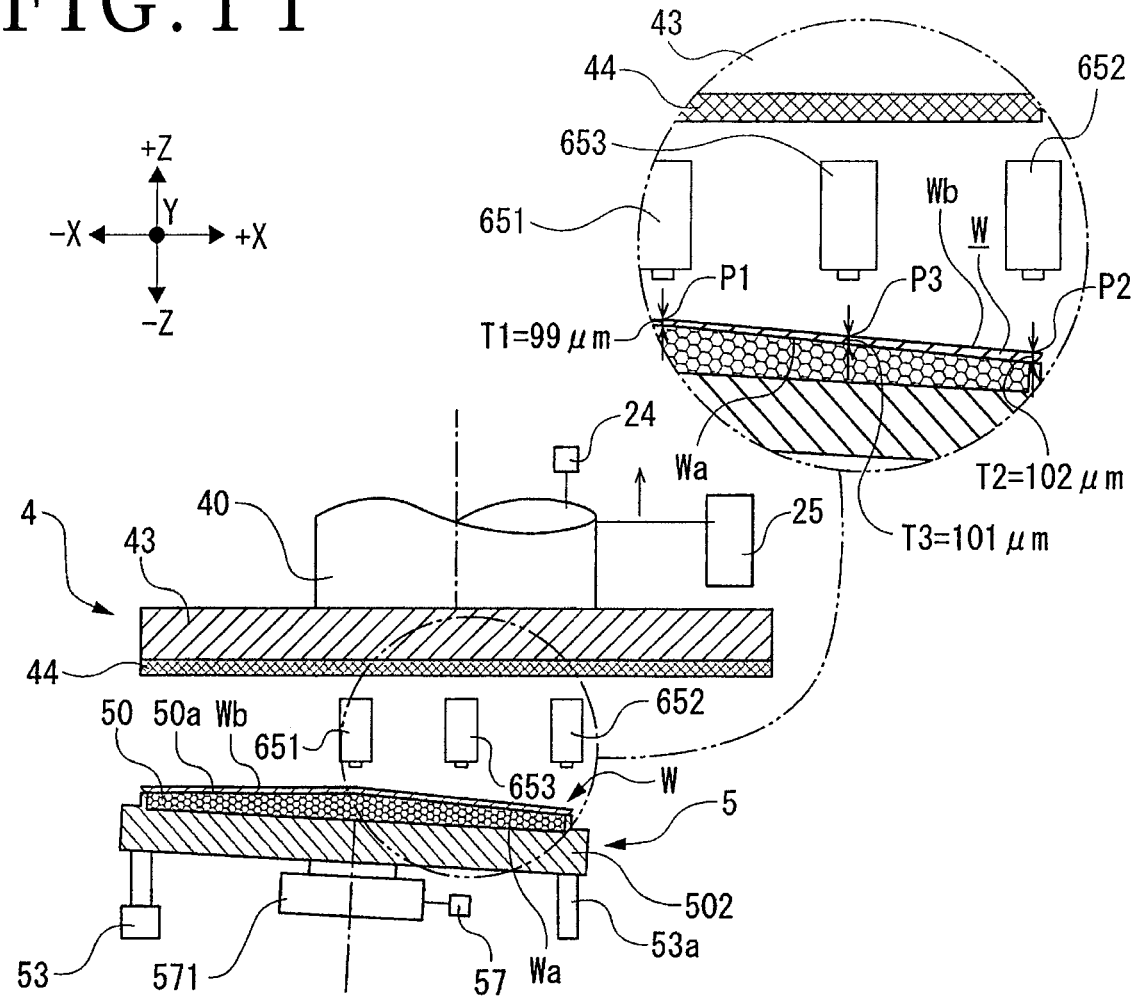
FIG. 11 is a sectional view illustrating a state in which the thickness of a disk-shaped workpiece is measured at three points of a first measurement point positioned at the center (center side) of a disk-shaped workpiece, a second measurement point positioned in the proximity of an outer circumferential edge (outer circumferential edge side) of the disk-shaped workpiece, and a third measurement point that is an intermediate point between the first measurement point and the second measurement point.

After the polishing step, the thickness of the disk-shaped workpiece W is measured at least at three points including, for example, a first measurement point P1 positioned at the center (center side) of the disk-shaped workpiece W depicted in FIG. 11, a second measurement point P2 positioned in the proximity of an outer circumferential edge (outer circumferential edge side) of the disk-shaped workpiece W, and a third measurement point P3 that is an intermediate point between the first measurement point P1 and the second measurement point P2. It is to be noted that the measurement points may include only two points of the first measurement point P1 and the second measurement point P2. In particular, after rotation of the holding table 5 is stopped, for example, the arm 650 of the polishing thickness measurement means 67 depicted in FIG. 1 is pivotally moved and positioned above a radius of the disk-shaped workpiece W (namely, above a region between the center and the outer circumferential edge of the disk-shaped workpiece W), and the first measurement point P1, the third measurement point P3, and the second measurement point P2 are positioned just below the optical sensors 651, 653, and 652, respectively.

For example, each of the optical sensors 651, 653, and 652 irradiates, from a built-in light emitting element thereof, measurement light upon the disk-shaped workpiece W positioned below the same and receives, at a light receiving element thereof, reflected light. Then, a light path difference when the light receiving element receives the reflected light reflected by the rear face Wb of the disk-shaped workpiece W and the reflected light reflected by the front face Wa after the light passes through the disk-shaped workpiece W is calculated, and thicknesses T1, T2, and T3 of the disk-shaped workpiece W at the first measurement point P1, the second measurement point P2, and the third measurement point P3 are measured from the calculated values of the light path difference on the basis of the principle of interferometry and so forth, respectively.

(5) Thickness Tendency Recognition Step

The optical sensors 651, 652, and 653 of the polishing thickness measurement means 67 send information of the measured thickness T1 at the first measurement point P1, the thickness T2 at the second measurement point P2, and the thickness T3 at the third measurement point P3 of the disk-shaped workpiece W to the control means 9 depicted in FIG. 1. The information sent to the control means 9 is stored into the storage unit 90 of the control means 9.

The control means 9 includes a thickness tendency recognition unit 91 that recognizes a tendency of the thickness (hereinafter referred to as "thickness tendency") in a diametrical direction of the disk-shaped workpiece W, for example, from the thickness T1 at the first measurement point P1, the thickness T2 at the second measurement point P2, and the thickness T3 at the third measurement point P3. For example, it is assumed that the measured thicknesses of the disk-shaped workpiece W at the first measurement point P1, the second measurement point P2, and the third measurement point P3 are the thicknesses T1=99 μm, T2=102 μm, and T3=101 μm, respectively. In this case, the thickness tendency recognition unit 91 decides that the disk-shaped workpiece W after polishing has a tendency that the thickness increases toward the outer side in a diametrical direction, in other words, the disk-shaped workpiece W after polishing has a tendency that it has a center recessed shape.

(6) Inclination Changing Step

Further, as the turntable 6 rotates in the counterclockwise direction as viewed from the +Z direction, the holding table 5 that holds the disk-shaped workpiece W after the polishing processing revolves until the holding table 5 moves to the proximity of the unloading arm 154*b* depicted in FIG. 1.

Then, the disk-shaped workpiece W sucked to and held on the holding table 5 and having been subjected to the polishing processing is sucked and held by the unloading arm 154*b*, and the suction by the suction source not depicted is stopped to cancel the suction and holding of the disk-shaped workpiece W by the holding table 5. The unloading arm 154*b* transports the disk-shaped workpiece W from the holding table 5 to the cleaning means 156, and cleaning of the disk-shaped workpiece W is performed by the cleaning means 156. The disk-shaped workpiece W for which the cleaning is performed is accommodated into the second cassette 151*a* by the robot 155.

For example, in the case where grinding is to be carried out for a new disk-shaped workpiece W before grinding, in order to allow, at the grinding step for the new next disk-shaped workpiece W, formation of a disk-shaped workpiece W of a thickness tendency reverse to the thickness tendency recognized at the thickness tendency recognition step (tendency that the thickness increases toward the outer side in a diametrical direction), the control means 9 changes the inclination relationship (relationship in inclination) between the rotation shaft 300 on which the grinding wheel 304 of the rough grinding means 30 or the finish grinding means 31 is mounted and the rotation shaft 571 of the holding table 5. In other words, the inclination relationship (relationship in inclination) between the rotation shaft 300 on which the grinding wheel 304 is mounted (namely, the rotation shaft 300 that rotates the grinding wheel 304) and the rotation shaft 571 of the holding table 5 is changed such that the thickness tendency recognized by the thickness tendency recognition step is weakened or cancelled.

Figure 12:
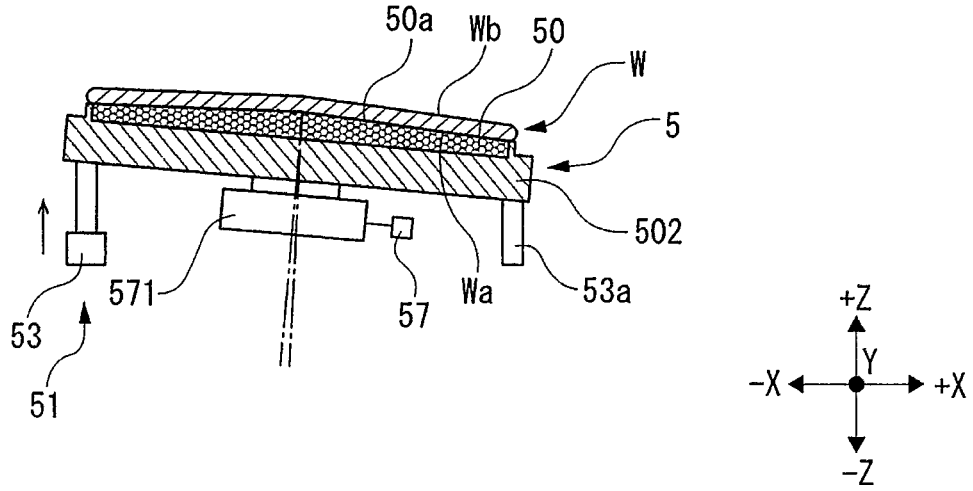
FIG. 12 is a sectional view illustrating a state in which the inclination relationship between a rotation shaft on which the grinding wheel is mounted and a rotation shaft of the holding table is changed in order to form a disk-shaped workpiece of a thickness tendency reverse to a thickness tendency recognized at a thickness tendency recognition step.

For example, in the case where the motor 533*a* of the driving unit 533 of the position adjustment unit 53 depicted in FIG. 2 is a stepping motor that operates with a driving pulse supplied from a pulse oscillator not depicted, the control means 9 counts the number of driving pulses supplied to the motor 533*a* thereby to grasp the inclination angle of the flange portion 521 by the position adjustment unit 53 and changes the relative inclination of the rotation shaft 571 of the holding table 5 with respect to the rotation shaft 300 in the vertical direction, on which the grinding wheel 304 of the rough grinding means 30 is mounted, through the inclination changing means 51. In particular, in the present embodiment, the inclination changing means 51 changes the inclination angle of the rotation shaft 571 such that the outer circumference side of the holding table 5 (outer circumferential side near to the inclination changing means 51) is lifted in the +Z direction by a predetermined distance under the control of the control means 9 as depicted in FIG. 12.

It is to be noted that the motor 533*a* of the driving unit 533 of the position adjustment unit 53 may otherwise be configured as a servomotor to which a rotary encoder is connected. The rotary encoder is connected to the control means 9 that additionally has a function as a servo amplifier, and after an operation signal is supplied from the control means 9 to the servomotor, the rotary encoder outputs an encoder signal (speed of the servomotor) to the control means 9. The control means 9 grasps the inclination angle of the rotation shaft 571 by the inclination changing means 51 from the received encoder signal.

Where the inclination relationship between the rotation shaft 300 on which the grinding wheel 304 is mounted and the rotation shaft 571 of the holding table 5 is changed, when grinding is carried out at the grinding step for a new disk-shaped workpiece W held subsequently on the holding table 5, the grinding can be proceeded in a state in which a region corresponding to the second measurement point P2 and a region corresponding to the third measurement point P3 at which the thickness of the disk-shaped workpiece W ground and polished last becomes thicker than that at the first measurement point P1 in the disk-shaped workpiece W after polishing are lifted relatively upwardly relative to the region corresponding to the first measurement point P1 with respect to the grinding face of the rough grinding whetstones 304*b* (finish grinding wheel 314*b*). Accordingly, a disk-shaped workpiece W having a thickness tendency (tendency that the thickness increases toward the inner side in a diametrical direction) reverse to the thickness tendency (tendency that the thickness increases toward the outer side in a diametrical direction) of the disk-shaped workpiece W for which polishing processing has been performed last, in other words, a disk-shaped workpiece W of a center projected shape, can be formed by completion of the grinding step.

Then, since, by carrying out the polishing processing described hereinabove for the disk-shaped workpiece W having a tendency that the thickness increases toward the inner side in a diametrical direction, polishing proceeds in a state in which the second measurement point P2 and the third measurement point P3 of the disk-shaped workpiece W having been unlikely to be polished in the polishing processing performed last are more likely to be polished (more likely to be contacted by the polishing pad 44). Therefore, the disk-shaped workpiece W after the new polishing processing is placed into a state in which it is flattened with a higher degree of accuracy than the disk-shaped workpiece W for which grinding and polishing have been performed last.

As described above, the processing method for a disk-shaped workpiece according to the present embodiment includes a holding step of causing the holding table 5 to hold a disk-shaped workpiece W, a grinding step of rotating the disk-shaped workpiece W and the grinding wheel 304 to grind the disk-shaped workpiece W with the rough grinding whetstones 304*b* (finish grinding wheel 314*b*), a polishing step of rotating, after the grinding step, the disk-shaped workpiece W and the polishing pad 44 to polish the disk-shaped workpiece W in a state in which the disk-shaped workpiece W is covered with the polishing pad 44, a measurement step of measuring, after the polishing step, the thickness of the disk-shaped workpiece W at three points including the first measurement point P1 positioned at the center (center side) of the disk-shaped workpiece W, the second measurement point P2 in the proximity of an outer circumferential edge (outer circumferential edge side) of the disk-shaped workpiece W and, for example, the third measurement point P3, a thickness tendency recognition step of recognizing a thickness tendency (for example, a tendency that a center recessed shape is formed) in a diametrical direction of the disk-shaped workpiece W from thicknesses T1, T2, and T3 of the disk-shaped workpiece W at the three measurement points P1, P2, and P3 measured at the measurement step, and an inclination changing step of changing an inclination relationship between the rotation shaft 300 on which the grinding wheel 304 is mounted and the rotation shaft 571 of the holding table 5 in order to form, at the grinding step, the disk-shaped workpiece W such that the disk-shaped workpiece W has a tendency (for example, a tendency that a center projected shape is formed) reverse to the thickness tendency recognized at the thickness tendency recognition step. This makes it possible to flatten a new disk-shaped workpiece, which is to be subjected to polishing processing subsequently, with a high accuracy in comparison with the disk-shaped workpiece W subjected to polishing processing last.

It is to be noted that, in the case where dressing is performed periodically for the polishing pad 44 during grinding and polishing processing, a phenomenon possibly occurs that, if the thickness of the polishing pad 44 decreases as a result of repetitions of dressing, then the polishing pad 44 is liable to become center recessed shape further. In contrast, with the processing method for a disk-shaped workpiece W according to the present embodiment, even where dressing is carried out periodically for the polishing pad 44, it is possible to flatten a new disk-shaped workpiece, which is to be subjected to polishing processing subsequently, with a high degree of accuracy in comparison with the disk-shaped workpiece W subjected to polishing processing last.

By measuring, at the measurement step, the thickness of the disk-shaped workpiece W at least at three measurement points including the two measurement points P1 and P2 and the third measurement point P3 that is an intermediate point between the first measurement point P1 and the second measurement point P2 and recognizing, at the thickness tendency recognition step, a thickness tendency in a diametrical direction of the disk-shaped workpiece W from the thicknesses T1 to T3 of the disk-shaped workpiece W at least at the three measurement points P1 to P3 as in the present embodiment, the inclination relationship can be changed more appropriately at the inclination changing step than that in the case where the number of measurement points is two including the first measurement point P1 and the second measurement point P2.

Embodiment 2 of Processing Method

Figure 13:
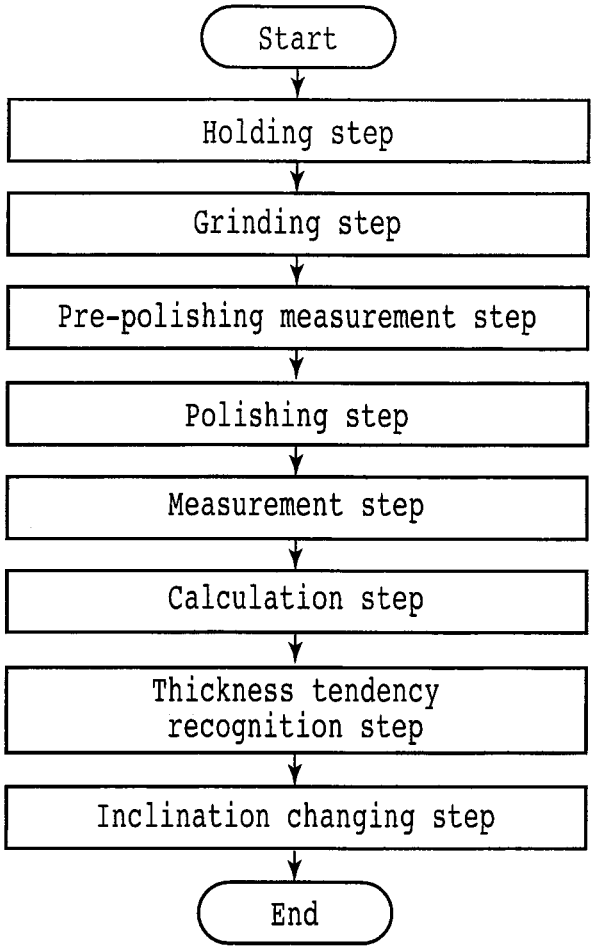
FIG. 13 is a flow chart illustrating a flow of steps of a processing method for a disk-shaped workpiece of an embodiment 2.

In the following, steps in the case where grinding processing and polishing processing are carried out for a disk-shaped workpiece W using the grinding and polishing apparatus 1 described hereinabove with reference to FIG. 1. The steps in the processing method for a disk-shaped workpiece according to the present embodiment (hereinafter referred to as processing method of the embodiment 2) are sequentially carried out in order, for example, as indicated in a flow chart depicted in FIG. 13.

(1) Holding Step for First Disk-Shaped Workpiece to (2) Grinding Step

Figure 14:
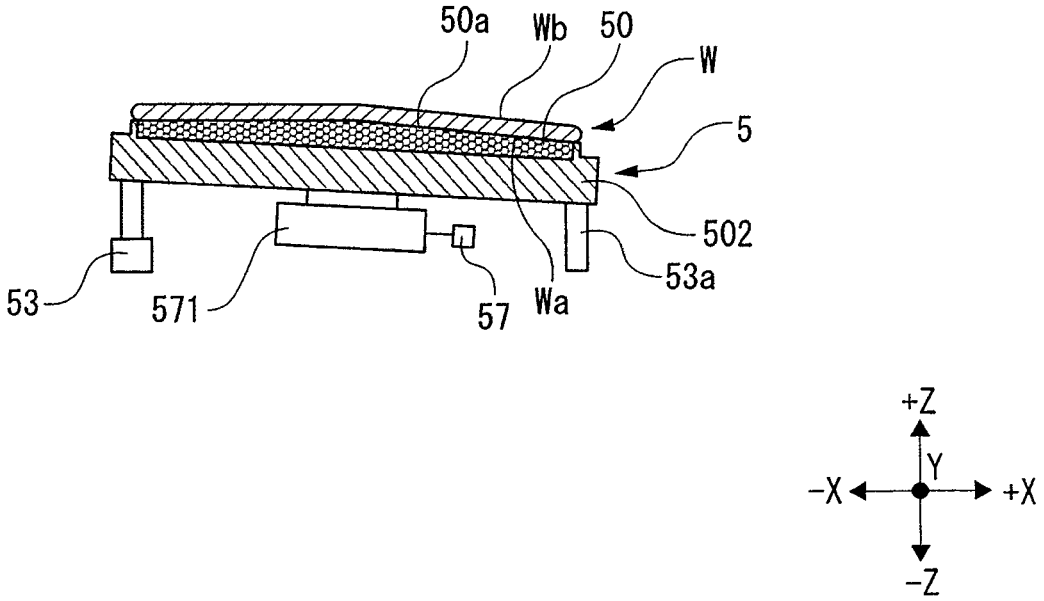
FIG. 14 is a sectional view illustrating a state in which a first disk-shaped workpiece is held by the holding table.
Figure 15:
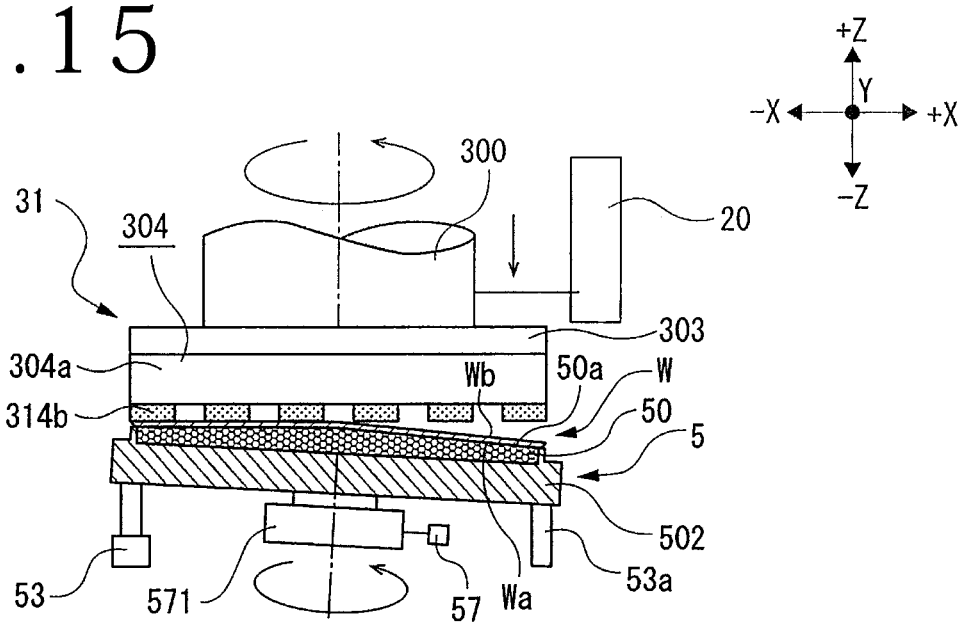
FIG. 15 is a sectional view illustrating a state in which the first plate-shaped workpiece and the grinding wheel are rotated and the disk-shaped workpiece is ground with the whetstones.

The holding step is performed similarly as in the case of the embodiment 1, and a disk-shaped workpiece W (hereinafter referred to as first disk-shaped workpiece W) is held by the holding table 5 as depicted in FIG. 14. Further, at the grinding step, similarly as in the case of the embodiment 1, rough grinding and finish grinding are performed, and as depicted in FIG. 15, the disk-shaped workpiece W is ground to a desired finish thickness (for example, 100 μm).

(3) Pre-Polishing Measurement Step for First Disk-Shaped Workpiece

Figure 16:
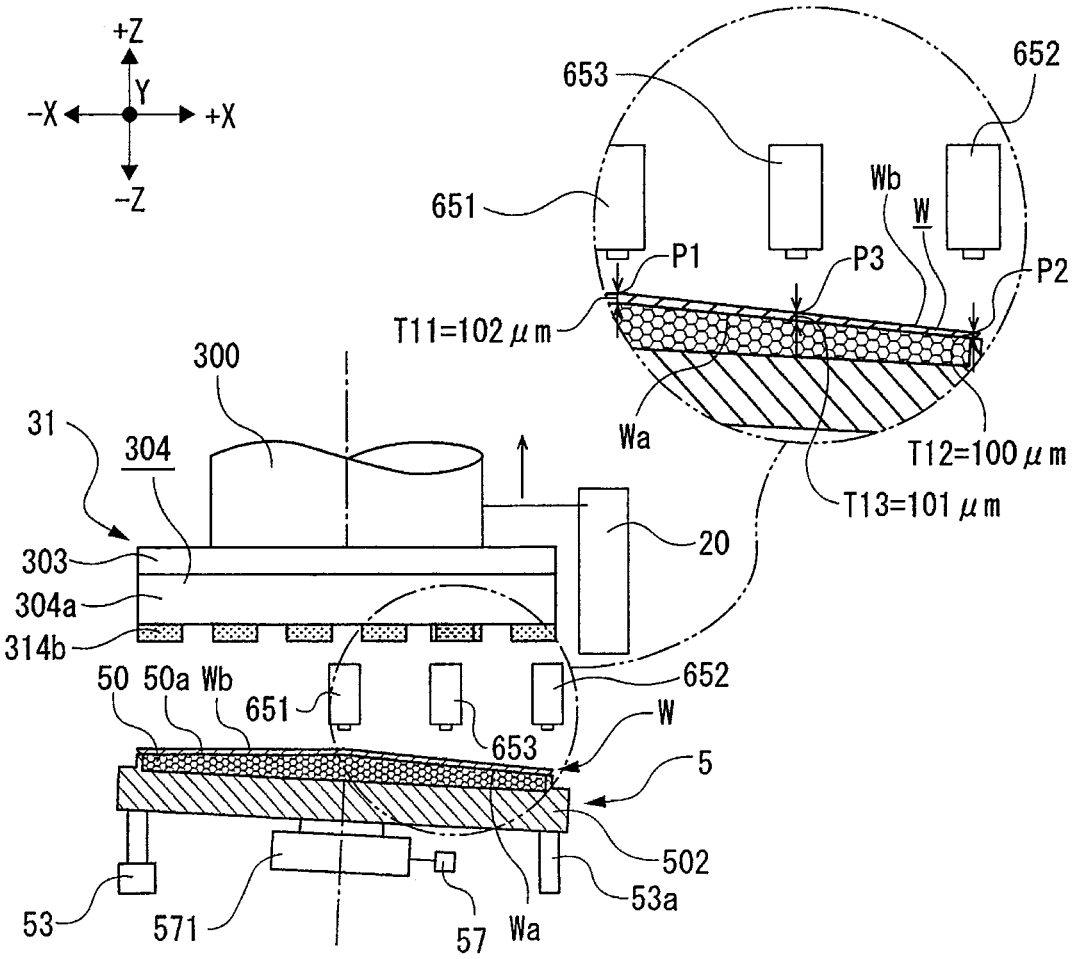
FIG. 16 is a sectional view illustrating a state in which the thickness of a disk-shaped workpiece is measured at three points of a first measurement point positioned at the center (center side) of a first disk-shaped workpiece before polishing, a second measurement point positioned in the proximity of an outer circumferential edge (outer circumferential edge side) of the disk-shaped workpiece, and a third measurement point that is an intermediate point between the first measurement point and the second measurement point.

Then, the thickness after finish grinding of the disk-shaped workpiece W is measured at least at three point including a first measurement point P1 positioned at the center (center side) of the disk-shaped workpiece W depicted in FIG. 16, a second measurement point P2 positioned in the proximity of an outer circumferential edge (outer circumferential edge side) of the disk-shaped workpiece W, and a third measurement point P3 that is an intermediate point between the first measurement point P1 and the second measurement point P2. It is to be noted that the number of measurement points may be only two including the first measurement point P1 and the second measurement point P2. In particular, rotation of the holding table 5 is stopped and the finish grinding wheel 314*b* is spaced away from the disk-shaped workpiece W, and then, for example, the arm 650 of the finish grinding thickness measurement means 66 depicted in FIG. 1 is pivotally moved so as to be positioned above a radius of the disk-shaped workpiece W (namely, above a region between the center and an outer circumferential edge of the disk-shaped workpiece W) and the first measurement point P1, the second measurement point P2, and the third measurement point P3 are positioned just below the optical sensors 651, 652, and 653, respectively. Then, thicknesses T11, T12, and T13 of the disk-shaped workpiece W at the first measurement point P1, the second measurement point P2, and the third measurement point P3 are measured by the optical sensors 651, 652, and 653, respectively.

The optical sensors 651, 652, and 653 of the finish grinding thickness measurement means 66 send information of the measured thickness T11 at the first measurement point P1, the thickness T12 at the second measurement point P2, and the thickness T13 at the third measurement point P3 of the disk-shaped workpiece W to the control means 9 depicted in FIG. 1. The information sent to the control means 9 is stored into the storage unit 90 of the control means 9. For example, it is assumed that the measured thicknesses after the finish polishing of the disk-shaped workpiece W at the first measurement point P1, the second measurement point P2, and the third measurement point P3 are the thicknesses T11=102 μm, T12=100 μm, and T13=101 μm, respectively.

(4) Polishing Step for First Disk-Shaped Workpiece

Figure 17:
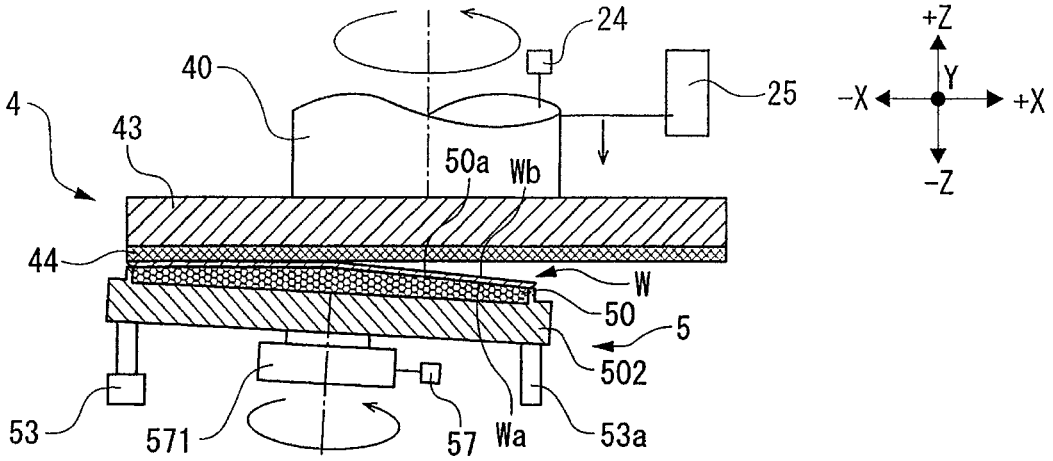
FIG. 17 is a sectional view illustrating a state in which the first disk-shaped workpiece and the polishing pad are rotated and polishing is performed in a state in which the polishing pad covers the disk-shaped workpiece.
Figure 18:
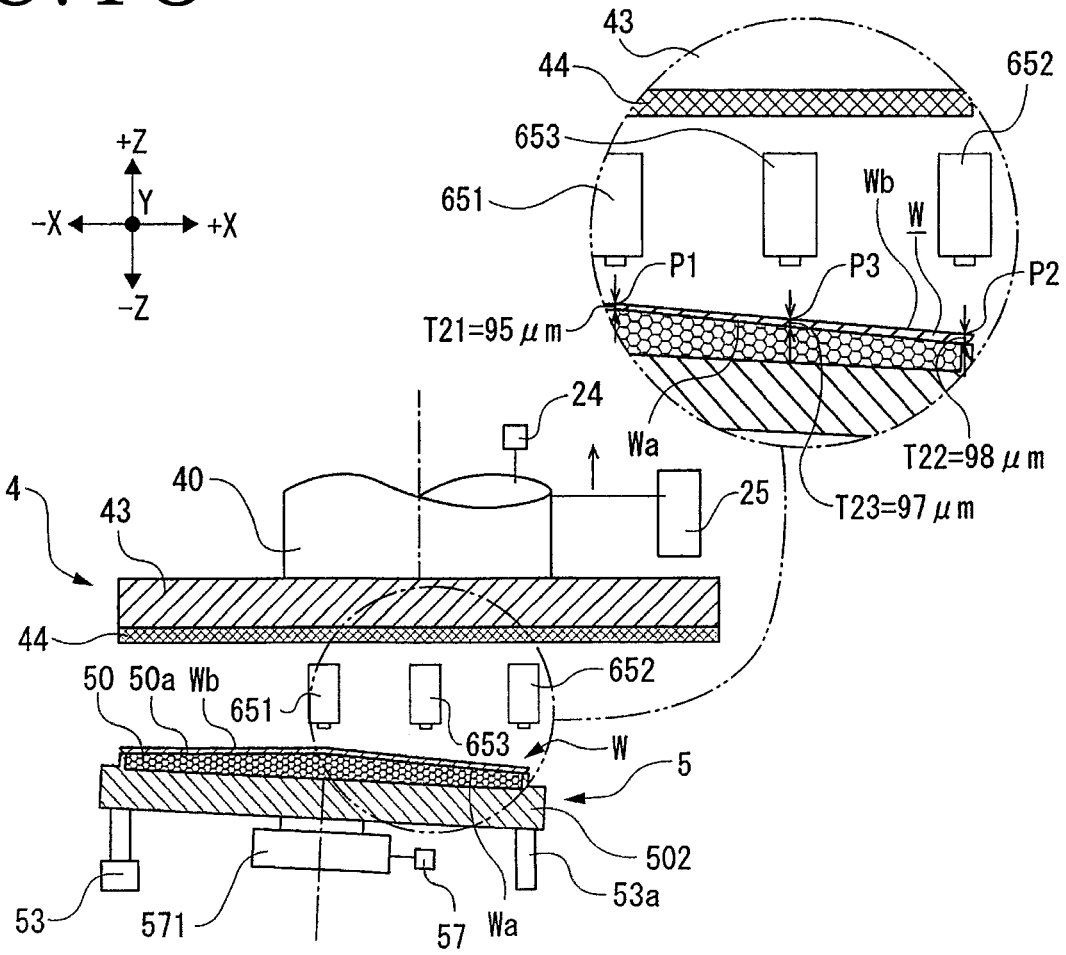
FIG. 18 is a sectional view illustrating a state in which the thickness of a disk-shaped workpiece is measured at three points of a first measurement point positioned at the center (center side) of the first disk-shaped workpiece after polishing, a second measurement point positioned in the proximity of an outer circumferential edge (outer circumferential edge side) of the disk-shaped workpiece, and a third measurement point that is an intermediate point between the first measurement point and the second measurement point.

Then, the disk-shaped workpiece W polished to the finish thickness and having the rear face Wb whose flatness is increased further is moved to a position below the polishing means 4, and the disk-shaped workpiece W is polished similarly as in the case of the embodiment 1 as depicted in FIG. 17. Then, after the polishing of the first disk-shaped workpiece W is completed, the polishing means 4 is moved in the +Z direction so as to be spaced away from the polished disk-shaped workpiece W as depicted in FIG. 18.

(5) Measurement Step for First Disk-Shaped Workpiece

After rotation of the holding table 5 is stopped, the first measurement point P1, the second measurement point P2, and the third measurement point P3 are positioned just below the optical sensors 651, 652, and 653 of the polishing thickness measurement means 67, respectively. Then, the thicknesses T21, T22, and T23 of the disk-shaped workpiece W at the first measurement point P1, the second measurement point P2, and the third measurement point P3 are measured by the optical sensors 651, 652, and 653, respectively. For example, the measured thicknesses are the thicknesses T21=95 μm, T22=98 μm, and T23=97 μm. It is to be noted that the number of measurement points may be only two including the first measurement point P1 and the second measurement point P2.

(6) Calculation Step for First Disk-Shaped Workpiece

For example, the CPU of the control means 9 subtracts the thicknesses T21=95 μm, T22=98 μm, and T23=97 μm after polishing of the disk-shaped workpiece W at the first measurement point P1, the second measurement point P2, and the third measurement point P3 depicted in FIG. 18 measured at the measurement step from the thicknesses T11=102 μm, T12=100 μm, and T13=101 μm depicted in FIG. 16 measured at the pre-polishing measurement step to calculate polishing removal amounts L1=102 μm−95 μm=7 μm, L2=100 μm−98 μm=2 μm, and L3=101 μm−97 μm=4 μm at the three measurement points, respectively.

(7) Thickness Tendency Recognition Step of First Disk-Shaped Workpiece

The optical sensors 651, 652, and 653 of the polishing thickness measurement means 67 send information of the measured thickness T21 at the first measurement point P1, the thickness T22 at the second measurement point P2, and the thickness T23 at the third measurement point P3 of the disk-shaped workpiece W to the control means 9 depicted in FIG. 1, respectively. For example, since, as depicted in FIG. 18, the measured thicknesses T21=95 μm, T22=98 μm, and T23=97 μm, the thickness tendency recognition unit 91 decides that the disk-shaped workpiece W after grinding has a tendency that the thickness thereof increases toward the outer side in a diametrical direction, namely, that the disk-shaped workpiece W has a tendency that it becomes center recessed shape.

When the turntable 6 depicted in FIG. 1 rotates in the counterclockwise direction as viewed from the +Z direction, the holding table 5 moves to the proximity of the unloading arm 154*b*. Then, the unloading arm 154*b* transports the disk-shaped workpiece W from the holding table 5 to the cleaning means 156. The first disk-shaped workpiece W for which cleaning has been performed is accommodated into the second cassette 151*a* by the robot 155.

(8) Inclination Changing Step for First Disk-Shaped Workpiece

Figure 19:
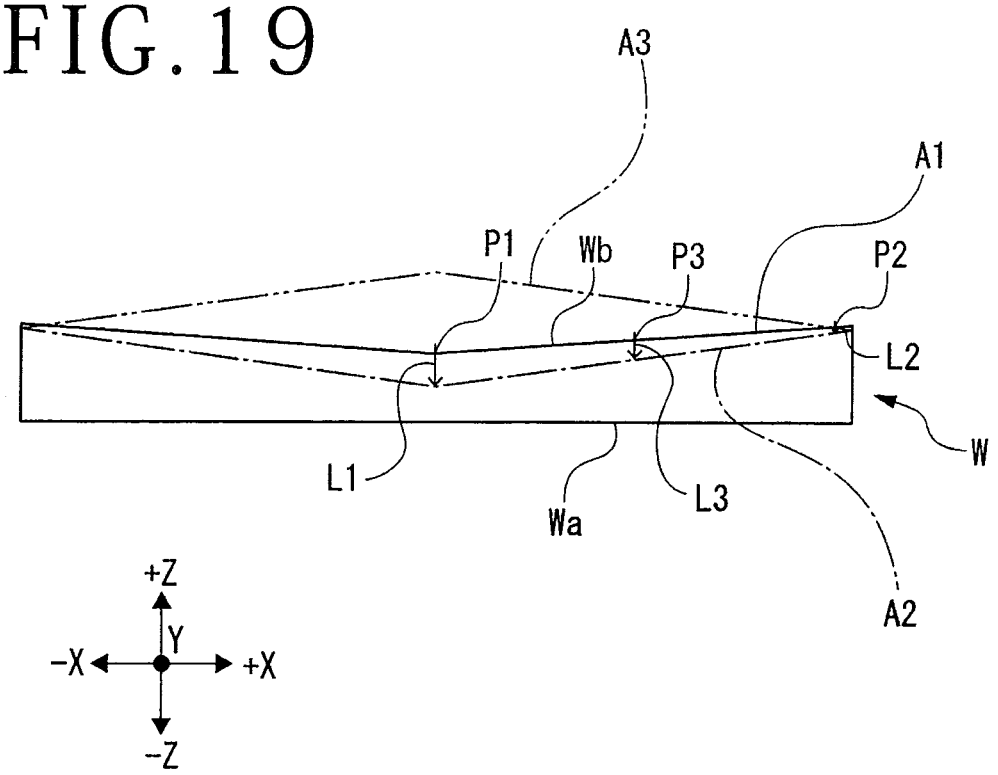
FIG. 19 is an explanatory view illustrating a thickness tendency recognized at a thickness tendency recognition step for the first disk-shaped workpiece and a thickness tendency where a polishing removal amount is subtracted from the recognized thickness tendency as well as a thickness tendency to be formed on a second disk-shaped workpiece at a next grinding step reverse to the thickness tendency where the polishing removal amount is subtracted.

At the inclination changing step in the embodiment 2, in order to allow a disk-shaped workpiece W (second disk-shaped workpiece W), which has a thickness tendency reverse to the thickness tendency of the disk-shaped workpiece W where the polishing removal amounts L1=7 μm, L2=2 μm, and L3=4 μm at the first measurement point P1, the second measurement point P2, and the third measurement point P3 calculated at the calculation step, respectively, are subtracted from the thickness tendency recognized at the tendency recognition step (tendency that the first disk-shaped workpiece W becomes center recessed shape), to be formed at the next grinding step, the inclination relationship between the rotation shaft 300 on which the grinding wheel 304 of the rough grinding means 30 or the finish grinding means 31 is mounted and the rotation shaft 571 of the holding table 5 is changed. In particular, the inclination relationship between the rotation shaft 300 on which the grinding wheel 304 is mounted and the rotation shaft 571 of the holding table 5 is changed such that the differences in thickness caused in the disk-shaped workpiece W by polishing (here, L1−L2=7 μm−2 μm=5 μm) can be cancelled. It is to be noted that thickness tendencies A2 where the polishing removal amounts L1 to L3 are subtracted from thickness tendencies A1 at the three measurement points P1 to P3 recognized at the thickness tendency recognition step in regard to the first disk-shaped workpiece W become thickness tendencies of a center recessed shape of a steeper inclination than the thickness tendency that the first disk-shaped workpiece W after polishing becomes center recessed shape as depicted in FIG. 19. Accordingly, a thickness tendency A3 of the second disk-shaped workpiece W reverse to the thickness tendency where the polishing removal amounts L1 to L3 are subtracted (tendency of the thickness to be formed at the next grinding step) becomes such a center projected shape thickness tendency as depicted in FIG. 19.

As a particular example of the change of the inclination relationship between the rotation shaft 300 on which the grinding wheel 304 of the rough grinding means 30 or the finish grinding means 31 is mounted and the rotation shaft 571 of the holding table 5, for example, the difference (L1−L2=5 μm) between the maximum polishing removal amount L1 and the minimum polishing removal amount L2 among the polishing removal amount L1=7 μm at the first measurement point P1, the polishing removal amount L2=2 μm at the second measurement point P2, and the polishing removal amount L3=4 μm at the third measurement point P3 is calculated by the control means 9 depicted in FIG. 1. Then, the difference becomes a correction value S1=5 μm for appropriately changing the inclination relationship between the rotation shaft 300 and the rotation shaft 571. In the present embodiment, the inclination changing means 51 changes the inclination angle of the rotation shaft 571 of the holding table 5 (for example, lifts the holding face 50*a* on the outer circumferential side proximate to the position adjustment unit 53 of the holding table 5 by a predetermined distance) under the control of the control means 9 such that the thickness after finish grinding becomes center projected shape by 5 μm (correction value S1=5 μm), namely, the thickness after finish grinding at the first measurement point P1 becomes a desired finish thickness 100 μm+5 μm (correction value S1)=105 μm, as depicted in FIG. 20.

(9) Holding Step for Second Disk-Shaped Workpiece to (10) Grinding Step

Figure 20:
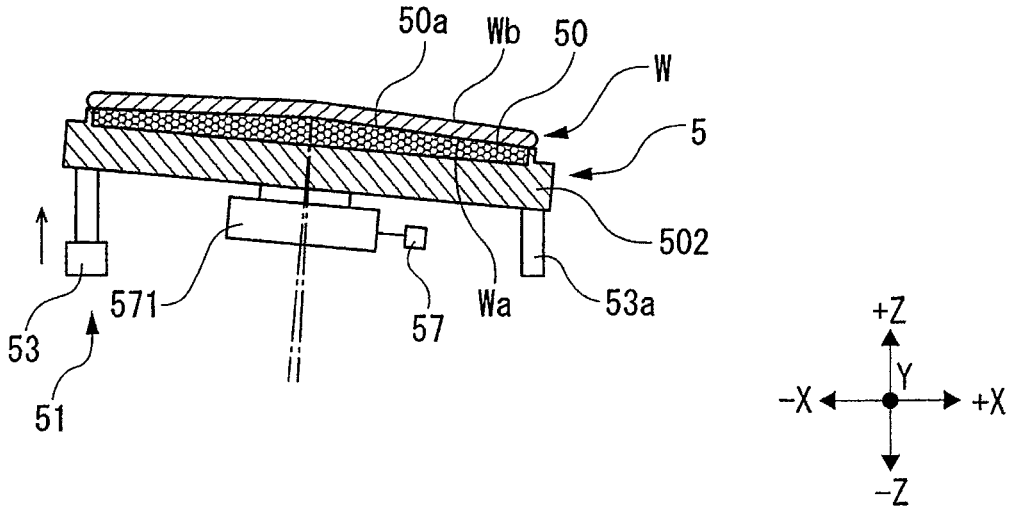
FIG. 20 is a sectional view illustrating a case in which the inclination of the rotation shaft of the holding table is changed in order to form a second disk-shaped workpiece of a thickness tendency reverse to the thickness tendency of the first disk-shaped workpiece.
Figure 21:
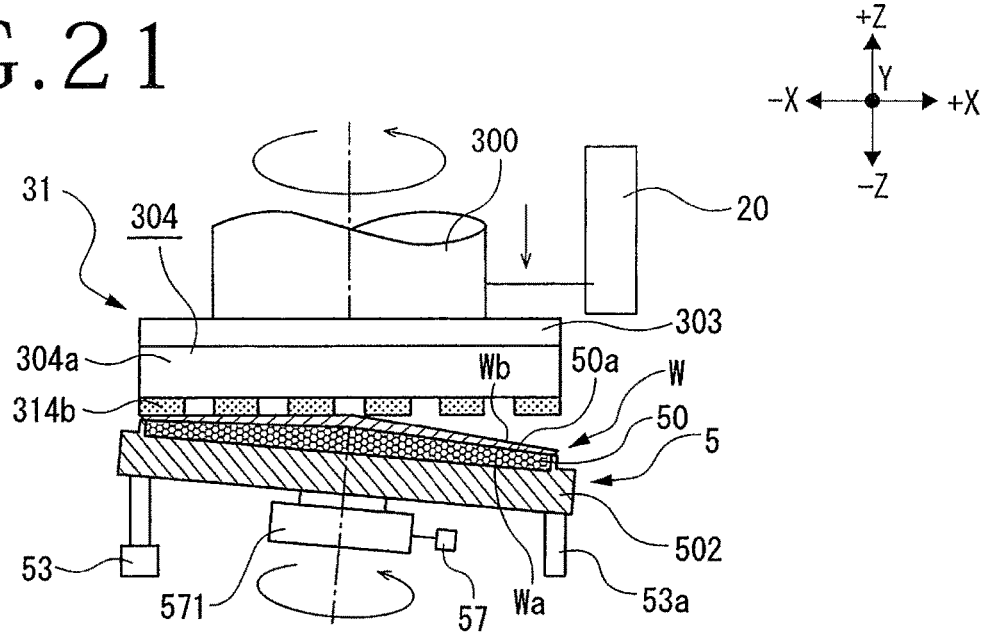
FIG. 21 is a sectional view illustrating a state in which the second disk-shaped workpiece is held by the holding table and is ground so as to have a desired thickness.

The holding step for a disk-shaped workpiece W to be newly subjected to grinding (hereinafter referred to as second disk-shaped workpiece W) is performed similarly as in the case for the first disk-shaped workpiece W, and the disk-shaped workpiece W is held by the holding table 5 as depicted in FIG. 20. Further, rough grinding and finish grinding at the grinding step are performed similarly as in the case of those for the first disk-shaped workpiece W except that the inclination of the rotation shaft 571 of the holding table 5 is changed, and since the disk-shaped workpiece W is ground to the desired thickness (for example, to 100 μm) such that the second disk-shaped workpiece W after the grinding has a thickness tendency of a center projected shape as depicted in FIG. 21.

(11) Pre-Polishing Measurement Step for Second Disk-Shaped Workpiece

Figure 22:
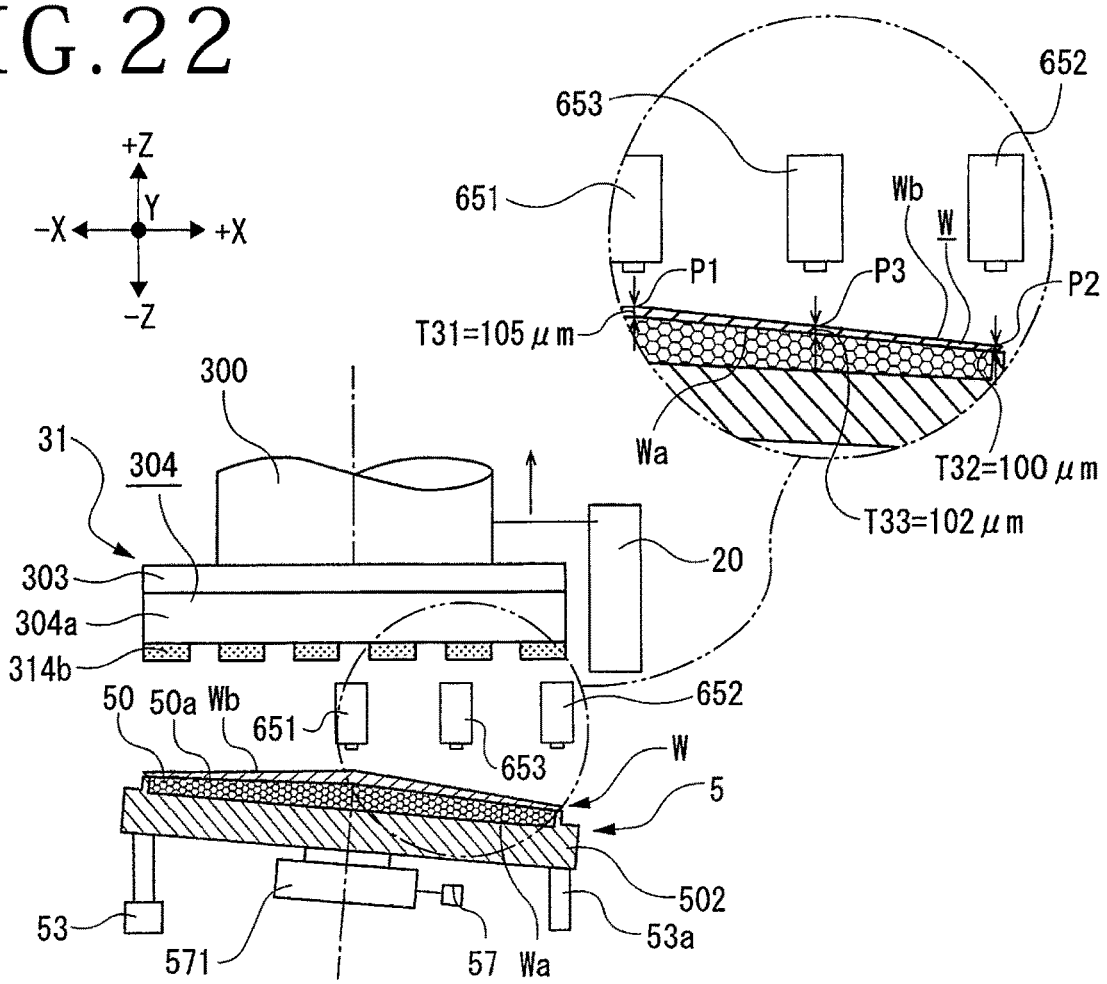
FIG. 22 is a sectional view illustrating a state in which the thickness of a disk-shaped workpiece is measured at three points of a first measurement point positioned at the center (center side) of the second disk-shaped workpiece before polishing, a second measurement point positioned in the proximity of an outer circumferential edge (outer circumferential edge side) of the disk-shaped workpiece, and a third measurement point that is an intermediate point between the first measurement point and the second measurement point.

Then, the thickness after finish polishing of the disk-shaped workpiece W is measured at three points of the first measurement point P1 to the third measurement point P3 of the second disk-shaped workpiece W depicted in FIG. 22.

Rotation of the holding table 5 is stopped and the finish grinding wheel 314*b* is spaced away from the disk-shaped workpiece W, and then the thicknesses T31, T32, and T33 of the disk-shaped workpiece W at the first measurement point P1, the second measurement point P2, and the third measurement point P3 are measured by the optical sensors 651, 652, and 653 of the finish grinding thickness measurement means 66 depicted in FIG. 1, respectively. It is to be noted that the number of measurement points may be only two of the first measurement point P1 and the second measurement point P2.

The optical sensors 651, 652, and 653 of the finish grinding thickness measurement means 66 send information of the measured thickness T31 at the first measurement point P1, the thickness T32 at the second measurement point P2, and the thickness T33 at the third measurement point P3 of the disk-shaped workpiece W to the control means 9 depicted in FIG. 1. For example, the measured thicknesses after the finish grinding of the disk-shaped workpiece W at the first measurement point P1, the second measurement point P2, and the third measurement point P3 are the thicknesses T31=105 μm, T32=100 μm, and T33=102 μm, by which a center projected shape is indicated.

(12) Polishing Step for Second Disk-Shaped Workpiece

Figure 23:
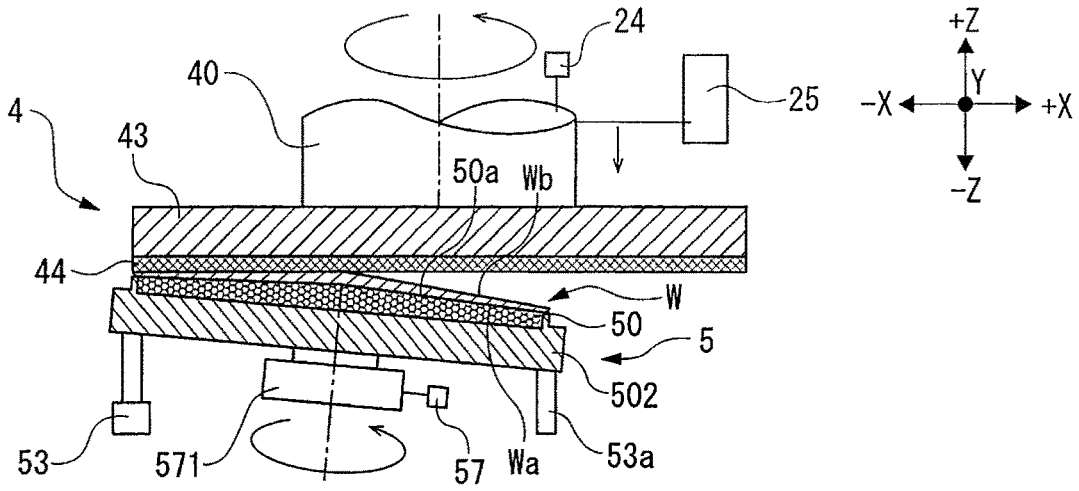
FIG. 23 is a sectional view illustrating a state in which the second disk-shaped workpiece and the polishing pad are rotated and polishing is performed in a state in which the polishing pad covers the disk-shaped workpiece.

Then, the disk-shaped workpiece W ground to the finish thickness and having further increased flatness at the rear face Wb thereof is moved to a position below the polishing means 4, and polishing is performed similarly as in the case for the first disk-shaped workpiece W except that the inclination of the rotation shaft 571 of the holding table 5 is changed as depicted in FIG. 23. Then, after the polishing of the second disk-shaped workpiece W is completed, the polishing means 4 is moved in the +Z direction by the polishing feeding means 25 so as to be spaced away from the disk-shaped workpiece W after the polishing processing.

(13) Measurement Step for Second Disk-Shaped Workpiece

Figure 24:
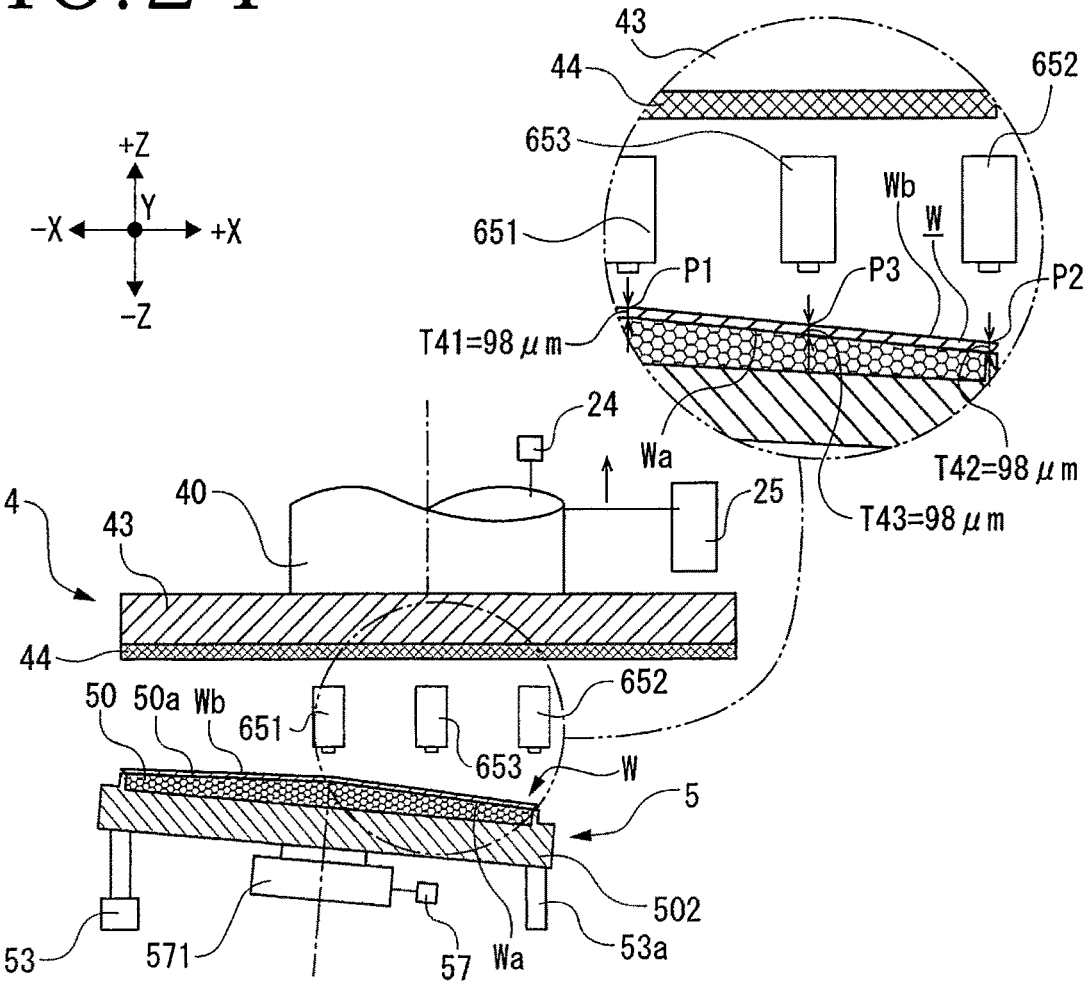
FIG. 24 is a sectional view illustrating a state in which the thickness of a disk-shaped workpiece is measured at three points of a first measurement point positioned at the center (center side) of the second disk-shaped workpiece after polishing, a second measurement point positioned in the proximity of an outer circumferential edge (outer circumferential edge side) of the disk-shaped workpiece, and a third measurement point that is an intermediate point between the first measurement point and the second measurement point.

After rotation of the holding table 5 is stopped, thicknesses T41, T42, and T43 of the second disk-shaped workpiece W at the first measurement point P1, the second measurement point P2, and the third measurement point P3 are measured by the optical sensors 651, 652, and 653 of the polishing thickness measurement means 67 as depicted in FIG. 24, respectively. For example, it is assumed that the thicknesses T41=98 μm, T42=98 μm, and T43=98 μm. It is to be noted that the number of measurement points may be only two of the first measurement point P1 and the second measurement point P2.

(14) Calculation Step for Second Disk-Shaped Workpiece

The CPU of the control means 9 subtracts the thicknesses T41=98 μm, T42=98 μm, and T43=98 μm after polishing of the disk-shaped workpiece W at the first measurement point P1, the second measurement point P2, and the third measurement point P3 measured at the measurement step depicted in FIG. 24 from the thicknesses T31=105 μm, T32=100 μm, and T33=102 μm after the finish grinding of the second disk-shaped workpiece W at the first measurement point P1, the second measurement point P2, and the third measurement point P3 measured at the pre-polishing measurement step depicted in FIG. 22 to calculate the polishing removal amounts L11=105 μm−98 μm=7 μm, L12=100 μm−98 μm=2 μm, and L13=102 μm−98 μm=4 μm at the three measurement points, respectively.

(15) Thickness Tendency Recognition Step for Second Disk-Shaped Workpiece

The optical sensors 651, 652, and 653 of the polishing thickness measurement means 67 send information of the measured thicknesses T41, T42, and T43 depicted in FIG. 24, respectively, to the control means 9 depicted in FIG. 1. For example, since the thicknesses after polishing of the disk-shaped workpiece W at the first measurement point P1, the second measurement point P2, and the third measurement point P3 are the thicknesses T41=98 μm, T42=98 μm, and T43=98 μm, respectively, the thickness tendency recognition unit 91 decides that the disk-shaped workpiece W after polishing is flat.

Thereafter, the second disk-shaped workpiece W is transported out of the holding table 5 and accommodated into the second cassette 151*a* depicted in FIG. 1.

The processing method for a disk-shaped workpiece according to the present embodiment includes a pre-polishing measurement step of measuring the thicknesses T11, T12, and T13 of a disk-shaped workpiece W depicted in FIG. 16 at least at the three measurement points P1, P2, and P3 including the first measurement point P1, the second measurement point P2 and, for example, the third measurement point P3 before a polishing step, and a calculation step of subtracting, before an inclination changing step, the thicknesses T21, T22, and T23 of the disk-shaped workpiece W at the three measurement points P1, P2, and P3 depicted in FIG. 18 measured at the measurement step from the thicknesses T11, T12, and T13 of the disk-shaped workpiece W at the three measurement points P1, P2, and P3 depicted in FIG. 16 measured at the pre-polishing measurement step to calculate polishing removal amounts L1, L2, and L3 at the three measurement points P1, P2, and P3, respectively. At the inclination changing step, in order to form, by a next grinding step, a new second disk-shaped workpiece W having a thickness tendency (center projected shape thickness tendency) reverse to the thickness tendency (center recessed shape thickness tendency) of a first disk-shaped workpiece W obtained by subtracting the polishing removal amounts L1 to L3 at the first measurement point P1, the second measurement point P2, and the third measurement point P3 from the thickness tendency (tendency that the first disk-shaped workpiece W becomes center recessed shape) recognized at the thickness tendency recognition step, the inclination relationship between the rotation shaft 300 on which the grinding wheel 304 is mounted and the rotation shaft 571 of the holding table 5 is changed. In short, the inclination relationship between the rotation shaft 300 on which the grinding wheel 304 is mounted and the rotation shaft 571 of the holding table 5 is changed such that a difference in thickness caused in the disk-shaped workpiece W by polishing can be cancelled. Consequently, the second disk-shaped workpiece W can be formed such that it has a center projected shape tendency after the grinding step, and a new disk-shaped workpiece W (second disk-shaped workpiece W) can be flattened with a higher degree of accuracy after polishing than the first disk-shaped workpiece W subjected to polishing processing last.

Since, at the pre-polishing measurement step, the thicknesses T11 to T13 of a disk-shaped workpiece W are measured at least at the three measurement points including the two measurement points P1 and P2 and the third measurement point P3 that is an intermediate point between the first measurement point P1 and the second measurement point P2, at the measurement step, the thicknesses T21 to T23 of the disk-shaped workpiece W are measured at least at the three measurement points P1 to P3, then, at the calculation step, the thicknesses T21 to T23 of the disk-shaped workpiece W at the three measurement points P1 to P3 measured at the measurement step are subtracted from the thicknesses T11 to T13 of the disk-shaped workpiece W at the three measurement points P1 to P3 measured at the pre-polishing measurement step to calculate the polishing removal amounts L1 to L3 at the three measurement points P1 to P3, whereafter, at the thickness tendency recognition step, a thickness tendency in a diametrical direction of the disk-shaped workpiece W is recognized from the thicknesses of the disk-shaped workpiece W after polishing at least at the measurement points P1 to P3, the inclination relationship described above can be changed more appropriately at the inclination changing step than that in the case where only two measurement points including the first measurement point P1 and the second measurement point P2 are used.

(16) Inclination Changing Step for Second Disk-Shaped Workpiece

At the inclination changing step in the present embodiment 2, in order to form, at a next grinding step, a third disk-shaped workpiece W having a thickness tendency (center projected shape thickness tendency) reverse to the thickness tendency (center recessed shape thickness tendency) of the disk-shaped workpiece W obtained by subtracting the polishing removal amounts L11=7 μm, L12=2 μm, and L13=4 μm at the first measurement point P1, the second measurement point P2, and the third measurement point P3 calculated from the thickness tendency (tendency that the second disk-shaped workpiece W after polishing becomes flat) recognized at the thickness tendency recognition step, the inclination relationship between the rotation shaft 300 on which the grinding wheel 304 of the rough grinding means 30 or the finish grinding means 31 is mounted and the rotation shaft 571 of the holding table 5 is changed. In short, the inclination relationship between the rotation shaft 300 on which the grinding wheel 304 is mounted and the rotation shaft 571 of the holding table 5 is changed such that a difference in thickness caused in the disk-shaped workpiece W by polishing can be cancelled.

Figure 25:
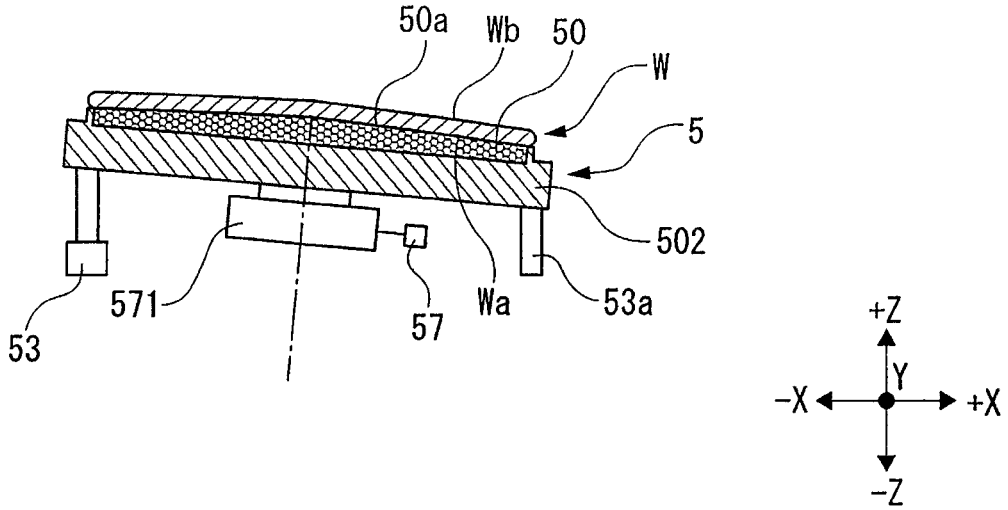
FIG. 25 is a sectional view depicting a case in which the inclination is maintained at the inclination changing step of the second disk-shaped workpiece.

In particular, for example, the difference between the maximum polishing removal amount L11 and the minimum polishing removal amount L12 (L11−L12=5 μm) from among the polishing removal amounts L11=7 μm, L12=2 μm, and L13=4 μm at the first measurement point P1, the second measurement point P2, and the third measurement point P3 is calculated by the control means 9. Then, the difference is used as a correction amount S2=5 μm for changing the inclination relationship between the rotation shaft 300 and the rotation shaft 571. The correction amount S2=5 μm is a value same as the correction value S1=5 μm calculated at the inclination changing step for the first disk-shaped workpiece W, the inclination relationship between the rotation shaft 300 on which the grinding wheel 304 is mounted and the rotation shaft 571 of the holding table 5 is maintained as depicted in FIG. 25, and the thickness after finish grinding at the first measurement point P1 of the next third disk-shaped workpiece W becomes the desired finish thickness 100 μm+5 μm (correction amount S2)=105 μm, which is same as that for the second disk-shaped workpiece W.

(17) Holding Step for Third Disk-Shaped Workpiece to (18) Grinding Step

Figure 26:
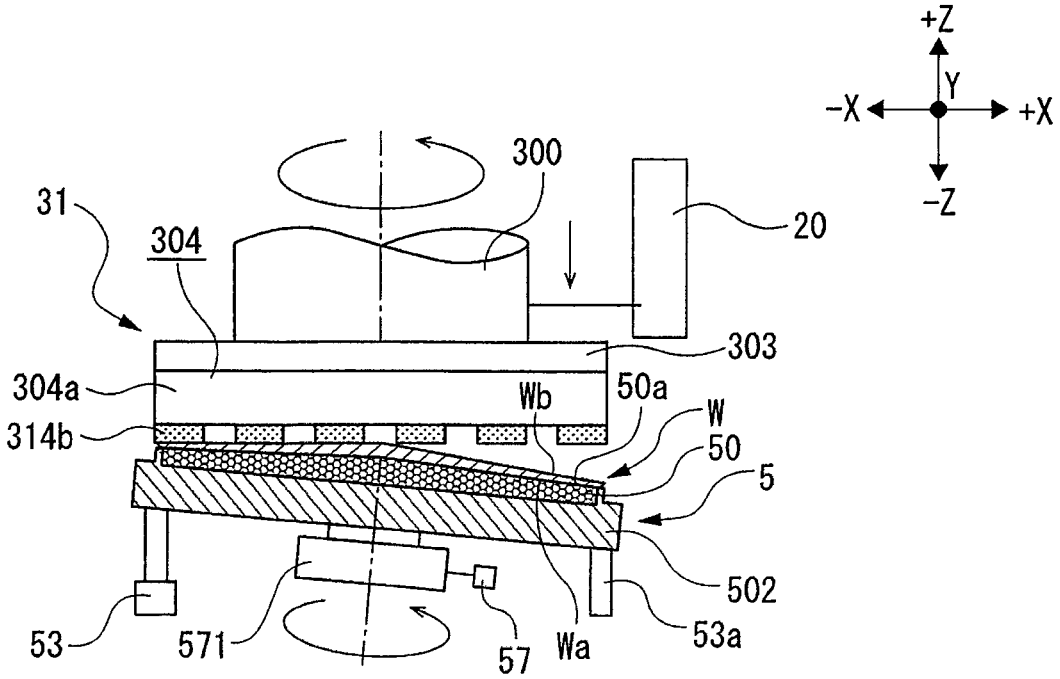
FIG. 26 is a sectional view illustrating a state in which a third disk-shaped workpiece is held by the holding table and is ground so as to have a desired thickness.

The holding step for a disk-shaped workpiece W for which grinding is to be carried out newly (hereinafter referred to as third disk-shaped workpiece W) is performed similarly as in the case of the holding step for the second disk-shaped workpiece W, and the disk-shaped workpiece W is held by the holding table 5 as depicted in FIG. 26. Further, similarly as in the case for the second disk-shaped workpiece W, rough grinding and finish grinding are performed such that the disk-shaped workpiece W has a desired finish thickness (for example, 100 μm). By this, the thickness tendency of the third disk-shaped workpiece W after grinding can be made center projected shape.

(19) Pre-Polishing Measurement Step for Third Disk-Shaped Workpiece

Figure 27:
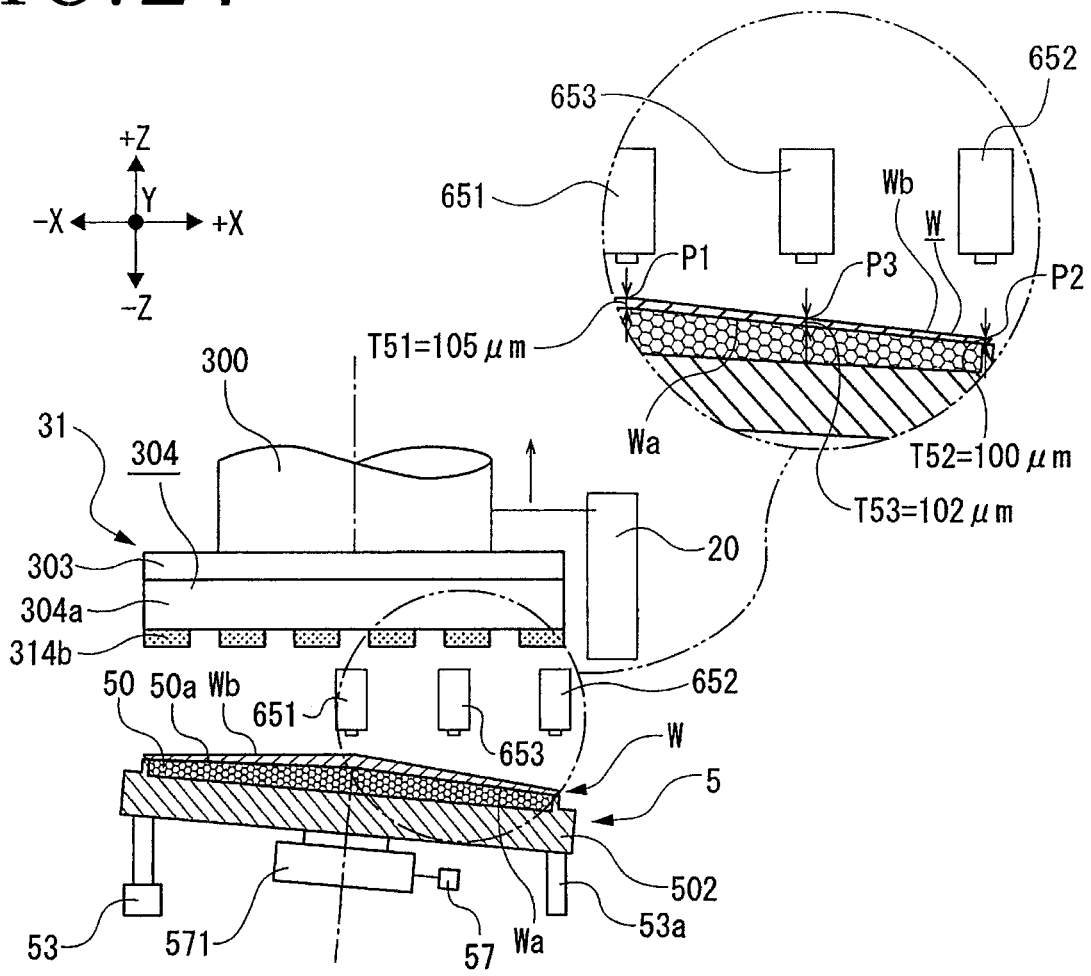
FIG. 27 is a view illustrating a state in which the thickness of a disk-shaped workpiece is measured at three points of a first measurement point positioned at the center (center side) of the third disk-shaped workpiece before polishing, a second measurement point positioned in the proximity of an outer circumferential edge (outer circumferential edge side) of the disk-shaped workpiece, and a third measurement point that is an intermediate point between the first measurement point and the second measurement point.

Then, the thickness of the disk-shaped workpiece W after finish grinding is measured at least at three points including the first measurement point P1, the second measurement point P2, and the third measurement point P3 of the third disk-shaped workpiece W depicted in FIG. 27. After rotation of the holding table 5 is stopped and the finish grinding wheel 314*b* is spaced away from the disk-shaped workpiece W, thicknesses T51, T52, and T53 of the disk-shaped workpiece W at the first measurement point P1, the second measurement point P2, and the third measurement point P3 are measured by the optical sensors 651, 652, and 653 of the finish grinding thickness measurement means 66 depicted in FIG. 1, respectively.

The optical sensors 651, 652, and 653 of the finish grinding thickness measurement means 66 send information of the measured thicknesses T51, T52, and T53 to the control means 9 depicted in FIG. 1, respectively. For example, the measured thicknesses are the thicknesses T51=105 μm, T52=100 μm, and T53=102 μm.

(20) Polishing Step for Third Disk-Shaped Workpiece

Figure 28:
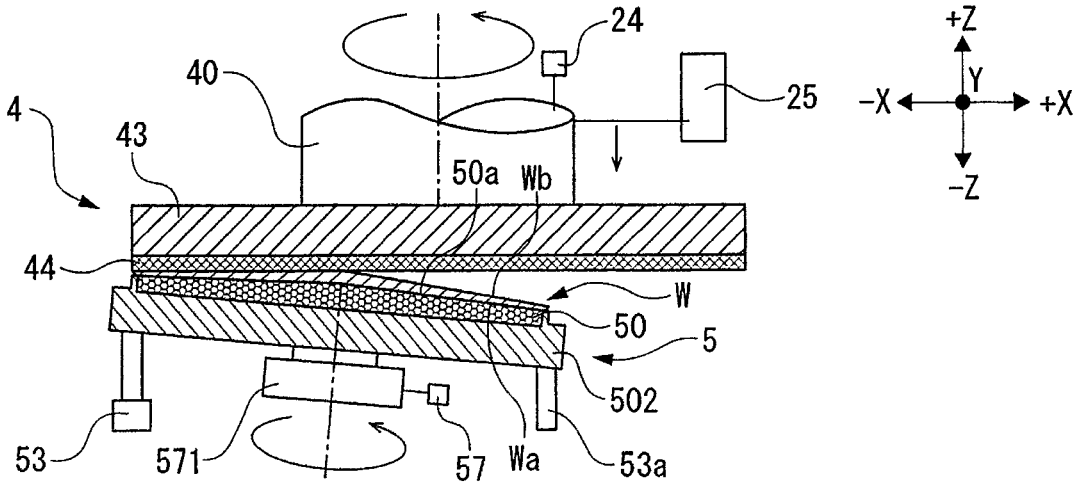
FIG. 28 is a sectional view illustrating a state in which the third disk-shaped workpiece and the polishing pad are rotated and polishing is performed in a state in which the polishing pad covers the disk-shaped workpiece.

Then, the disk-shaped workpiece W ground to a finish thickness is moved down to a position below the polishing means 4, and polishing is performed similarly as in the case for the second disk-shaped workpiece W as depicted in FIG. 28. Then, after the polishing of the third disk-shaped workpiece W is completed, the polishing means 4 is moved in the +Z direction by the polishing feeding means 25 to space the polishing means 4 away from the disk-shaped workpiece W after polishing processing.

(21) Measurement Step for Third Disk-Shaped Workpiece

Figure 29:
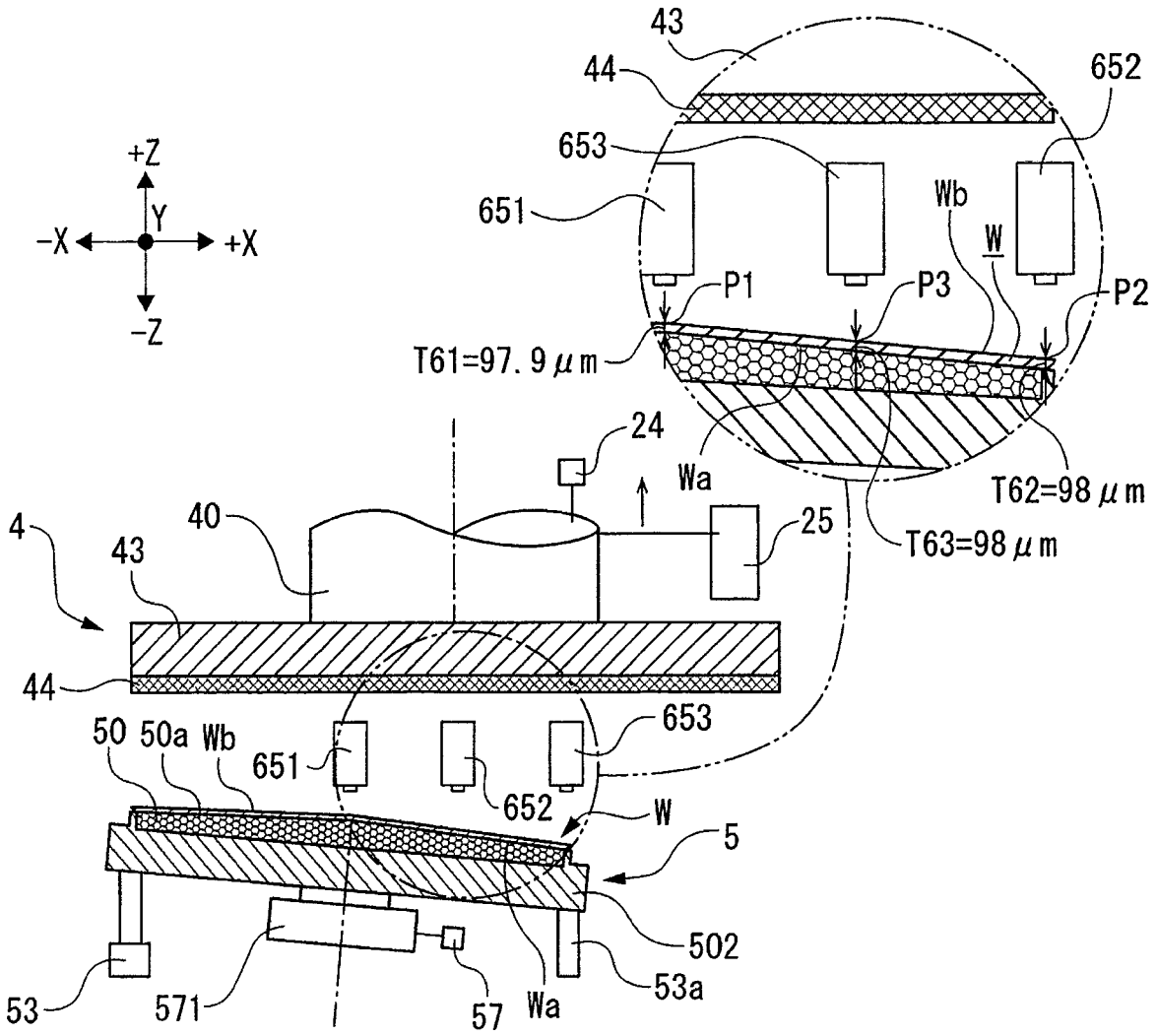
FIG. 29 is a sectional view illustrating a state in which the thickness of a disk-shaped workpiece is measured at three points of a first measurement point positioned at the center (center side) of the third disk-shaped workpiece after polishing, a second measurement point positioned in the proximity of an outer circumferential edge (outer circumferential edge side) of the disk-shaped workpiece, and a third measurement point that is an intermediate point between the first measurement point and the second measurement point.

After rotation of the holding table 5 is stopped, the thicknesses T61, T62, and T63 of the third disk-shaped workpiece W at the first measurement point P1, the second measurement point P2, and the third measurement point P3 are measured by the optical sensors 651, 652, and 653 of the polishing thickness measurement means 67 as depicted in FIG. 29, respectively. For example, the measured thicknesses are the thickness T61=97.9 μm, the thickness T62=98 μm, and the thickness T63=98 μm.

(22) Calculation Step for Third Disk-Shaped Workpiece

For example, the CPU of the control means 9 subtracts the thicknesses T61=97.9 μm, T62=98 μm, and T63=98 μm after polishing of the disk-shaped workpiece W at the first measurement point P1, the second measurement point P2, and the third measurement point P3 measured at the measurement step depicted in FIG. 29 from the thicknesses T51=105 μm, T52=100 μm, and T53=102 μm after finish grinding for the third disk-shaped workpiece W at the first measurement point P1, the second measurement point P2, and the third measurement point P3 measured at the pre-polishing measurement step depicted in FIG. 27 to calculate the polishing removal amounts L21=105 μm−97.9 μm=7.1 μm, L22=100 μm−98 μm=2 μm, and L23=102 μm−98 μm=4 μm at the three measurement points, respectively.

(23) Thickness Tendency Recognition Step for Third Disk-Shaped Workpiece

Since the measured thicknesses of the disk-shaped workpiece W after polishing are the thicknesses T61=97.9 μm, T62=98 μm, and T63=98 μm as depicted in FIG. 29, the thickness tendency recognition unit 91 decides that the disk-shaped workpiece W after the polishing has a little center recessed shape. In particular, since the polishing removal amount changes by deformation of the polishing pad 44 and so forth, the thickness tendency recognition unit 91 decides that the flatness of the disk-shaped workpiece W after polishing decreases a little.

Thereafter, the third disk-shaped workpiece W is transported out of the holding table 5 and accommodated into the second cassette 151*a* depicted in FIG. 1.

(24) Inclination Changing Step for Third Disk-Shaped Workpiece

At the inclination changing step in the present embodiment 2, in order to form, by a next grinding step, a disk-shaped workpiece W (fourth disk-shaped workpiece W) having a thickness tendency (center projected shape thickness tendency) reverse to the thickness tendency (center recessed shape thickness tendency) of the third disk-shaped workpiece W obtained by subtracting the polishing removal amounts L21=7.1 μm, L22=2 μm, and L23=4 μm at the first measurement point P1, the second measurement point P2, and the third measurement point P3 calculated at the calculation step from the thickness tendency (tendency that the third disk-shaped workpiece W becomes a little center recessed shape) recognized at the thickness tendency recognition step, the inclination relationship between the rotation shaft 300 on which the grinding wheel 304 of the rough grinding means 30 or the finish grinding means 31 is mounted and the rotation shaft 571 of the holding table 5 is changed. In short, the inclination relationship between the rotation shaft 300 on which the grinding wheel 304 is mounted and the rotation shaft 571 of the holding table 5 is changed such that a difference in thickness caused in the disk-shaped workpiece W by polishing can be cancelled.

In particular, for example, the difference between the maximum polishing removal amount L21 and the minimum polishing removal amount L22 (L21−L22=5.1 μm) from among the polishing removal amount L21=7.1 μm, L22=2 μm, and L23=4 μm is calculated by the control means 9. Then, while the tendency has become such that the first measurement point P1 at the center of the third disk-shaped workpiece W after polishing is polished more by 0.1 μm than that of the second disk-shaped workpiece W, the difference is used as a correction value S3=5.1 μm for changing the inclination relationship between the rotation shaft 300 and the rotation shaft 571.

In the present embodiment 2, under the control of the control means 9, the inclination changing means 51 changes the inclination angle of the rotation shaft 571 of the holding table 5 (for example, changes of lifting the holding face 50*a* on the outer circumferential side of the holding table 5 by a predetermined distance) such that the thickness after finish grinding of the next fourth disk-shaped workpiece W becomes center projected shape by 5.1 μm (correction value S3=5.1 μm), namely, the thickness after finish grinding at the first measurement point P1 of the fourth disk-shaped workpiece W becomes the desired finish thickness 100 μm+5.1 μm (correction value S3)=105.1 μm. By this, different from the third disk-shaped workpiece W with which a little difference in flatness has been caused as depicted in FIG. 29 by a change of the polishing removal amount by deformation of the polishing pad 44 and so forth after polishing, the processing condition is corrected so as to achieve following of a change of the polishing removal amount such that no difference occurs in flatness after polishing of the fourth disk-shaped workpiece W, and the thickness tendency after the grinding step of the fourth disk-shaped workpiece W can be change appropriately.

As a result, the next fourth disk-shaped workpiece W can be formed in a center projected shape thickness tendency after the grinding step, and further, the next fourth disk-shaped workpiece W can be flattened with high accuracy after polishing than the third disk-shaped workpiece W subjected to polishing processing precedently, namely, the thicknesses after polishing of the fourth disk-shaped workpiece W at the first measurement point P1, the second measurement point P2, and the third measurement point P3 can be made equal, for example, to 98 μm similarly to the second disk-shaped workpiece W.

The processing method for a disk-shaped workpiece according to the present invention is not limited to the embodiment 1 or 2 described above, and it is a matter of course that the present invention may be carried out in various forms without departing from the technical scope thereof. Further, also the components of the grinding and polishing apparatus 1 depicted in the accompanying drawings are not restrictive and can be changed suitably within a scope within which the advantageous effects of the present invention can be demonstrated.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A processing method for a disk-shaped workpiece by which a disk-shaped workpiece held on a holding face of a holding table is polished with a polishing pad after the disk-shaped workpiece is ground with whetstones, the processing method comprising:

a holding step of causing the holding table to hold a front face of a disk-shaped workpiece;

a grinding step of rotating a grinding wheel on which the whetstones are disposed annularly and the disk-shaped workpiece to grind a rear face of the disk-shaped workpiece with the whetstones;

a polishing step of rotating, after the grinding step, the disk-shaped workpiece and the polishing pad in a state in which the polishing pad covers the overall rear face of the disk-shaped workpiece to polish the disk-shaped workpiece;

a measurement step of measuring, after the polishing step, a thickness of the disk-shaped workpiece at least at two measurement points of a first measurement point positioned on a center side of the disk-shaped workpiece and a second measurement point positioned at an outer circumferential edge side of the disk-shaped workpiece;

a thickness tendency recognition step of recognizing a thickness tendency in a diametrical direction of the disk-shaped workpiece from a thickness of the disk-shaped workpiece at least at the two measurement points measured at the measurement step; and an inclination changing step of changing an inclination relationship between a rotation shaft for rotating the grinding wheel and a rotation shaft of the holding table on a basis of the thickness tendency recognized at the thickness tendency recognition step.

2. The processing method for a disk-shaped workpiece according to claim 1, wherein, at the measurement step, the thickness of the disk-shaped workpiece is measured at least at three measurement points of the two measurement points and a third measurement point that is an intermediate point between the first measurement point and the second measurement point, and, at the thickness tendency recognition step, a thickness tendency in a diametrical direction of the disk-shaped workpiece is recognized from the thicknesses of the disk-shaped workpiece at least at the three measurement points.

3. The processing method for a disk-shaped workpiece according to claim 2, wherein the measurement step includes simultaneously measuring the thickness of the disk-shaped workpiece at least at the three measurement points.

4. The processing method for a disk-shaped workpiece according to claim 1, further comprising:

a pre-polishing measurement step of measuring, before the polishing step, the thickness of the disk-shaped workpiece at least at the two measurement points of the first measurement point and the second measurement point; and a calculation step of subtracting, before the inclination changing step, the thicknesses of the disk-shaped workpiece at least at the two measurement points measured at the measurement step from the thicknesses of the disk-shaped workpiece at least at the two measurement points measured at the pre-polishing measurement step to calculate a polishing removal amount at least at the two measurement points, wherein, at the inclination changing step, the inclination relationship between the rotation shaft for rotating the grinding wheel and the rotation shaft of the holding table is changed on a basis of the thickness tendency recognized at the thickness tendency recognition step and the polishing removal amount.

5. The processing method for a disk-shaped workpiece according to claim 4, wherein, at the pre-polishing measurement step, the thickness of the disk-shaped workpiece at least at the three measurement points of the two measurement points and a third measurement point that is an intermediate point between the first measurement point and the second measurement point;

at the measurement step, the thickness of the disk-shaped workpiece is measured at least at the three measurement points;

at the calculation step, the thicknesses of the disk-shaped workpiece at least at the three measurement points measured at the measurement step are subtracted from the thicknesses of the disk-shaped workpiece at least at the three measurement points measured at the pre-polishing measurement step to calculate a polishing removal amount at least at the three measurement points; and at the thickness tendency recognition step, the thickness tendency in a diametrical direction of the disk-shaped workpiece is recognized from the thicknesses of the disk-shaped workpiece at least at the three measurement points.

6. The processing method for a disk-shaped workpiece according to claim 1, wherein the thickness tendency recognition step recognizes a tendency that the thickness increases or decreases from a center side of the workpiece to an outer side of the workpiece in a diametrical direction of the workpiece.

7. The processing method for a disk-shaped workpiece according to claim 1, wherein the measurement step includes simultaneously irradiating light at the workpiece at the at least two measurement points and receiving reflected light from the at least two measurement points.

8. The processing method for a disk-shaped workpiece according to claim 1, wherein the measurement step includes simultaneously measuring the thickness of the disk-shaped workpiece at least at the two measurement points.

* * * * *